US009444156B2

(12) United States Patent
Chastain et al.

(10) Patent No.: US 9,444,156 B2
(45) **Date of Patent: *Sep. 13, 2016**

(54) COAXIAL CONNECTOR GROUNDING INSERTS

(71) Applicant: PERFECTVISION MANUFACTURING, INC., Little Rock, AR (US)

(72) Inventors: Robert J. Chastain, Maumelle, AR (US); Glen David Shaw, Conway, AR (US); Charles Darwin Davidson, Jr., Little Rock, AR (US)

(73) Assignee: PERFECTVISION MANUFACTURING, INC, Little Rock, AR (US)

( * ) Notice: Subject to any disclaimer, the term of this patent is extended or adjusted under 35 U.S.C. 154(b) by 68 days.

This patent is subject to a terminal disclaimer.

(21) Appl. No.: 14/495,505

(22) Filed: Sep. 24, 2014

(65) Prior Publication Data

US 2015/0033551 A1 Feb. 5, 2015

Related U.S. Application Data

(63) Continuation-in-part of application No. 14/047,956, filed on Oct. 7, 2013, now Pat. No. 9,160,083, which is a continuation of application No. 13/373,782, filed on Nov. 30, 2011, now Pat. No. 8,556,654.

(60) Provisional application No. 61/920,296, filed on Dec. 23, 2013.

(51) Int. Cl.

| | |
|---|---|
| ***H01R 13/648*** | (2006.01) |
| ***H01R 9/05*** | (2006.01) |
| ***H01R 24/40*** | (2011.01) |

(52) U.S. Cl.

CPC ..... *H01R 9/0527* (2013.01); *Y10T 29/49123* (2015.01)

(58) Field of Classification Search

CPC ..... H01R 2103/00; H01R 4/646; H01R 9/05–9/053; H01R 13/648; H01R 24/40; H01R 24/42; H01R 24/2103; H01R 13/658; H01R 13/6592

USPC ..... 439/578–585, 99

See application file for complete search history.

(56) References Cited

U.S. PATENT DOCUMENTS

| | | | |
|---|---|---|---|
| 2,280,728 | A | 4/1942 | Streib |
| 2,757,351 | A | 7/1956 | Klostermann |
| 3,184,706 | A | 5/1965 | Atkins |
| 3,292,136 | A | 12/1966 | Somerset |
| 3,332,052 | A | 7/1967 | Rusinyak |
| 3,448,430 | A | 6/1969 | Kelly |
| 3,665,371 | A | 5/1972 | Cripps |
| 3,671,922 | A | 6/1972 | Zerlin |
| 3,678,445 | A | 7/1972 | Brancaleone |
| 3,681,739 | A | 8/1972 | Komick |
| 3,739,076 | A | 6/1973 | Schwartz |
| 3,835,443 | A | 9/1974 | Arnold |
| 4,106,839 | A | 8/1978 | Cooper |
| 4,128,293 | A | 12/1978 | Oaoli |
| 4,330,166 | A | 5/1982 | Cooper |

(Continued)

*Primary Examiner* — Gary Paumen

(74) *Attorney, Agent, or Firm* — Paul D. Chancellor; Ocean Law

(57) ABSTRACT

A coaxial cable connector and a grounding insert extending between an elongated hollow post and a nut interior and providing an electrically conductive path therebetween.

19 Claims, 20 Drawing Sheets

(56) References Cited

U.S. PATENT DOCUMENTS

| | | | | |
|---|---|---|---|---|
| 4,423,919 | A | 1/1984 | Hills | |
| 4,426,127 | A | 1/1984 | Kubota | |
| 4,531,805 | A | 7/1985 | Werth | |
| 4,703,988 | A | 11/1987 | Raux | |
| 4,808,128 | A | 2/1989 | Werth | |
| 4,979,911 | A | 12/1990 | Spencer | |
| 5,002,503 | A | 3/1991 | Campbell | |
| 5,066,248 | A | 11/1991 | Gaver, Jr. | |
| 5,083,943 | A | 1/1992 | Tarrant | |
| 5,683,263 | A | 11/1997 | Hsu | |
| 5,722,856 | A | 3/1998 | Fuchs | |
| 5,769,652 | A | 6/1998 | Wider | |
| 5,975,951 | A | 11/1999 | Burris | |
| 6,332,815 | B1 | 12/2001 | Bruce | |
| 6,406,330 | B2 | 6/2002 | Bruce | |
| 6,716,062 | B1 | 4/2004 | Palinkas | |
| 7,114,990 | B2 | 10/2006 | Bence | |
| 7,479,035 | B2 | 1/2009 | Bence | |
| 7,507,117 | B2 | 3/2009 | Amidon | |
| 7,753,705 | B2 | 7/2010 | Montena | |
| 7,845,976 | B2 | 12/2010 | Matthews | |
| 7,892,005 | B2 | 2/2011 | Haube | |
| 7,892,024 | B1 | 2/2011 | Chen | |
| 7,955,126 | B2 | 6/2011 | Bence | |
| 8,192,237 | B2 | 6/2012 | Purdy et al. | |
| 8,313,345 | B2 | 11/2012 | Purdy | |
| 8,323,060 | B2 | 12/2012 | Purdy et al. | |
| 8,579,658 | B2 | 11/2013 | Youtsey | |
| 8,888,526 | B2 * | 11/2014 | Burris | H01R 13/6581 439/578 |
| 9,028,276 | B2 * | 5/2015 | Wilson | H01R 9/0524 439/578 |
| 9,033,730 | B2 * | 5/2015 | Lu | H01R 13/648 439/578 |
| 2009/0098770 | A1 | 4/2009 | Bence | |
| 2011/0230091 | A1 | 9/2011 | Krenceski et al. | |
| 2011/0306236 | A1 | 12/2011 | Addario et al. | |
| 2013/0102189 | A1 | 4/2013 | Montena | |

* cited by examiner

COAXIAL CONNECTOR GROUNDING INSERTS

PRIORITY CLAIM AND INCORPORATION BY REFERENCE

This application claims the benefit of U.S. Prov. Pat. App. No. 61/920,296 filed Dec. 23, 2013 and is a continuation-in-part of U.S. patent application Ser. No. 14/047,956 filed on Oct. 7, 2013 which is a continuation of U.S. patent application Ser. No. 13/373,782 filed Nov. 30, 2011 (now U.S. Pat. No. 8,556,654 issued Oct. 15, 2013), all of which are incorporated herein in their entireties and for all purposes.

BACKGROUND OF THE INVENTION

1. Field of the Invention

The present invention relates generally to coaxial cable connectors. More particularly, the present invention relates to coaxial F-connectors adapted to insure the establishment of a proper ground during installation. Known prior art is classified in United States Patent Class 439, Subclasses 241, 247, 322, 548, 553, 554, 585, and 587.

2. Discussion of the Related Art

Popular cable television systems and satellite television receiving systems depend upon coaxial cable for distributing signals. As is known in the satellite TV arts, coaxial cable in such installations is terminated by F-connectors that threadably establish the necessary signal wiring connections. The F-connector forms a "male" connection portion that fits to a variety of receptacles, forming the "female" portion of the connection.

F-connectors include a tubular post designed to slide over coaxial cable dielectric material and under the outer conductor at the prepared end of the coaxial cable. The exposed, conductive sheath is usually folded back over the cable jacket. The cable jacket and folded-back outer conductor extend generally around the outside of the tubular post and are typically coaxially received within the tubular connector. A continuity contact between the sheath and conductive portions of the connector is needed. Moreover, electrical contact must be made with the threaded head or nut of the connector that should contact the female socket to which the connection is made.

F-connectors have numerous advantages over other known fittings, such as RCA, BNC, and PL-259 connectors, in that no soldering is needed for installation, and costs are reduced as parts are minimized. For example, with an F-connector, the center conductor of a properly prepared coaxial cable fitted to it forms the "male" portion of the receptacle connection, and no separate part is needed. A wide variety of F-connectors are known in the art, including the popular compression type connector that aids in rapid assembly and installation. Hundreds of such connectors are seen in U.S. Patent Class 439, particularly Subclass 548.

However, the extremely high bandwidths and frequencies distributed in conjunction with modern satellite installations implicates a variety of strict quality control factors. For example, the electrical connection established by the F-connector must not add electrical resistance to the circuit. It must exhibit a proper surge impedance to maintain a wide bandwidth, in the order of several Gigahertz. Numerous physical design requirements exist as well. For example, connectors must maintain a proper seal against the environment, and they must function over long time periods through extreme weather and temperature conditions. Requirements exist governing frictional insertion and disconnection or withdrawal forces as well.

Importantly, since a variety of coaxial cable diameters exist, it is imperative that satisfactory F-connectors function with differently sized cables, such as RG-6 and RG-59 coaxial cables that are most popular in the satellite television art.

It is important to establish an effective electrical connection between the F-connector, the internal coaxial cable, and the terminal socket. Proper installation techniques require adequate torqueing of the connector head. In other words, it is desired that the installer appropriately tighten the connector during installation. A dependable electrical grounding path must be established through the connector body to the grounded shield or jacket of the coaxial cable. Threaded F-connector nuts should be installed with a wrench to establish reasonable torque settings. Critical tightening of the F nut to the threaded female socket or fixture applies enough pressure to the inner conductor of the coaxial cable to establish proper electrical connections. When fully tightened, the head of the tubular post of the connector directly engages the edge of the outer conductor of the appliance port, thereby making a direct electrical ground connection between the outer conductor of the appliance port and the tubular post; in turn, the tubular post is engaged with the outer conductor of the coaxial cable.

Many connector installations, however, are not properly completed. It is a simple fact in the satellite and cable television industries that many F-connectors are not appropriately tightened by the installer. The common installation technique is to torque the F-connector with a small wrench during installation. In some cases installers only partially tighten the F-connector. Some installations are only hand-tightened. As a consequence, proper electrical continuity may not be achieved. Such F-connectors will not be properly "grounded," and the electrical grounding path can be compromised and can become intermittent. An appropriate low resistance, low loss connection to the female target socket, and the equipment connected to it, will not be established. Unless an alternate ground path exists, poor signal quality, and RFI leakage, will result. This translates to signal loss or degradation to the customer.

U.S. Pat. No. 3,678,445 issued Jul. 18, 1972 discloses a shield for eliminating electromagnetic interference in an electrical connector. A conductive shielding member having a spring portion snaps into a groove for removably securing the shield. A second spring portion is yieldable to provide electrical contact between the first shell member and a second movable shell member.

U.S. Pat. No. 3,835,443 issued Sep. 10, 1974 discloses an electromagnetic interference shield for an electrical connector comprising a helically coiled conductive spring interposed between mating halves of the connector. The coiled spring has convolutions slanted at an oblique angle to the center axis of the connector. Mating of the connector members axially flattens the spring to form an almost continuous metal shield between the connector members.

U.S. Pat. No. 3,439,046 issued Jun. 12, 1973 discloses a coaxial connector with an internal, electrically conductive coil spring is mounted between adjacent portions of connector. As an end member is rotatably threaded toward the housing, an inwardly directed annular bevel engages the spring and moves it inwardly toward an electrically shielded portion of the cable. The spring is compressed circumferentially so that its inner periphery makes electrical grounding contact with the shielded portion of the cable.

U.S. Pat. No. 5,066,248 issued Nov. 19, 1991 discloses coaxial cable connector comprising a housing sleeve, a connector body, a locking ring, and a center post. A stepped annular collar on the connector body ensures metal-to-metal contact and grounding.

U.S. Pat. No. 4,106,839 issued Aug. 15, 1978 shows a coaxial connector with a resilient, annular insert between abutting connector pieces for grounding adjacent parts. A band having a cylindrical surface is seated against an internal surface. Folded, resilient fingers connected with the band are biased into contact. The shield has tabs for mounting, and a plurality of folded integral, resilient fingers for establishing a ground.

U.S. Pat. No. 4,423,919 issued Jan. 3, 1984 discloses a connector with having a cylindrical shell with radial flange, a longitudinal key, and a shielding ring fitted over the shell and adjacent to the flange. The shielding ring comprises a detent having end faces configured to abut connector portions when the detent fits within the keyway, whereby the shell is prevented from rotating.

U.S. Pat. No. 4,330,166 issued May 18, 1982 discloses an electrical connector substantially shielded against EMP and EMI energy with an internal, conductive spring washer seated in the plug portion of the connector. A wave washer made from beryllium copper alloy is preferred.

U.S. Pat. No. 6,406,330 issued Jun. 18, 2002 employs an internal, beryllium copper clip ring for grounding. The clip ring forms a ground circuit between a male member and a female member of the electrical connector. The clip ring includes an annular body having an inner wall and an outer wall comprising a plurality of circumferentially spaced slots.

U.S. Pat. No. 7,114,990 issued Oct. 3, 2006 discloses a coaxial cable connector with an internal grounding clip establishing a grounding path between an internal tubular post and the connector. The grounding clip comprises a C-shaped metal clip with an arcuate curvature that is non-circular. U.S. Pat. No. 7,479,035 issued Jan. 20, 2009 shows a similar F-connector grounding arrangement.

U.S. Pat. No. 7,753,705 issued Jul. 13, 2010 discloses an RF seal for coaxial connectors. The seal comprises a flexible brim, a transition band, and a tubular insert with an insert chamber defined within the seal. In a first embodiment the flexible brim is angled away from the insert chamber, and in a second embodiment the flexible brim is angled inward toward the insert chamber. A flange end of the seal makes a compliant contact between the port and connector faces when the nut of a connector is partially tightened, and becomes sandwiched firmly between the ground surfaces when the nut is properly tightened. U.S. Pat. No. 7,892,024 issued Feb. 22, 2011 shows a similar grounding insert for F-connectors.

U.S. Pat. No. 7,824,216 issued Nov. 2, 2010 discloses a coaxial connector comprising a body, a post including a flange having a tapered surface, and a nut having an internal lip with a tapered surface which oppositely corresponds to the tapered surface of the post when is assembled, and a conductive O-ring between the post and the nut for grounding or continuity. Similar U.S. Pat. No. 7,845,976 issued Dec. 7, 2010 and U.S. Pat. No. 7,892,005 issued Feb. 22, 2011 use conductive, internal O-rings for both grounding and sealing.

U.S. Pat. No. 6,332,815 issued Dec. 25, 2001 and U.S. Pat. No. 6,406,330 issued Jun. 18, 2002 utilize clip rings made of resilient, conductive material such as beryllium copper for grounding. The clip ring forms a ground between a male member and a female member of the connector.

U.S. Pat. No. 6,716,062 issued Apr. 6, 2004 discloses a coaxial cable F connector with an internal coiled spring that establishes continuity. The spring biases the nut toward a rest position wherein not more than three revolutions of the nut are necessary to bring the post of the connector into contact.

SUMMARY OF THE INVENTION

The present invention provides coaxial cable connectors. In an embodiment, a connector ground continuity method includes the steps of: providing a coaxial cable connector including a threaded nut; providing an elongated, hollow post, the post including a portion that abuts a nut interior for rotatably coupling said post to said nut; coaxially disposing a tubular body over said post, the body having opposed forward and trailing portions, the forward portion engaging the post; slidably coupling the body trailing portion and a tubular end cap; and, providing a continuously curved springform insert having a wall defining inner and outer surfaces; providing plural tabs extending from the insert inner surface toward an insert axis of revolution; the insert tabs engaging a periphery of the post; and, the insert outer surface engaging an interior of the nut; wherein the insert completes an electrical path between the nut and the post by simultaneously contacting and grasping the post with said inner side while contacting the nut interior with said outer side.

Our coaxial cable connectors are of the compressible type. The connectors comprise a rigid nut with a faceted drive head adapted to be torqued during installation of a fitting. The head has an internally threaded, tubular stem, for threadably mating with a typical socket or receptacle. An elongated post coupled to the nut includes a shank, which can be barbed, that engages the prepared end of a coaxial cable. An elongated, tubular body is coupled to the post. When the device is compressed, an end cap is press fitted to the body, coaxially engaging a body shank portion and closing the fitting.

In known F-connector designs the internal post establishes electrical contact between the coaxial cable sheath and metallic parts of the coaxial fitting, such as the nut. Also, the elongated, tubular shank extends from the post to engage the coaxial cable, making contact with the metallic, insulative sheath.

However, since improper or insufficient tightening of the nut during F-connector installation is so common, and since continuity and/or electrical grounding suffer as a result, our design includes internal grounding inserts that remedy the problem. All embodiments of our grounding insert include means for contacting and grasping the post, and means for contacting the nut, to establish a redundant grounding path between the nut, the post, and the coaxial cable to which the fitting is fastened.

A preferred grounding insert comprises a circular band, preferably made of beryllium copper alloy. In assembly, the grounding insert band coaxially engages the post. Multiple radially spaced spring clips defined around the band securely grasp a flange portion of the post. The band is seated within a ring groove within the nut, making electrical contact.

An alternative grounding insert comprises a tubular band for contacting and grasping the post flange. The band is integral with a flared, projecting skirt having a polygonal cross section. The skirt comprises a plurality of vertices and a plurality of facets therebetween. In assembly the band yieldably grasps the periphery of the post flange to establish electrical contact. Skirt vertices abut the nut's internal ring groove. Electrical contact between the insert, the post, the nut, and the coaxial cable is thus insured, despite insufficient tightening of the nut.

Thus the primary object of our invention is to provide suitable grounding within an F-connector to overcome electrical connection problems associated with improper installation. More particularly, an object of our invention is to provide dependable electrical connections between coaxial connectors, especially F-connectors, and female connectors or sockets.

Another object of the present invention is to provide internal coaxial cable structure for establishing a grounding path in an improperly-tightened coaxial cable connector. A similar object is to provide a proper ground, even though required torque settings have been ignored.

Another related object of the present invention to provide a reliable ground connection between a connector and a target socket or port, even if the connector is not fully tightened.

It is another object of the present invention to provide such a coaxial cable connector which establishes and maintains a reliable ground path.

It is still another object of the present invention to provide such a coaxial connector that can be manufactured economically.

Another object of our invention is to provide a connector of the character described that establishes satisfactory EMP, EMI, and RFI shielding.

A related object is to provide a connector of the character described that establishes a decent ground during installation of the male connector to the various types of threaded female connections even though applied torque may fail to meet specifications.

Another essential object is to establish a proper ground electrical path with a socket even where the male connector is not fully torqued to the proper settings.

Another important object is to minimize resistive losses in a coaxial cable junction.

A still further object is to provide a connector suitable for use with demanding large, bandwidth systems approximating three GHz.

A related object is to provide an F-connector ideally adapted for home satellite systems distributing multiple high definition television channels.

Another important object is to provide a connector of the character described that is weather proof and moisture resistant.

Another important object is to provide a compression F-connector of the character described that can be safely and properly installed without deformation of critical parts during final compression.

These and other objects and advantages of the present invention, along with features of novelty appurtenant thereto, will appear or become apparent in the course of the following descriptive sections.

BRIEF DESCRIPTION OF THE DRAWINGS

The present invention is described with reference to the accompanying figures. These figures, incorporated herein and forming part of the specification, illustrate embodiments of the invention and, together with the description, further serve to explain its principles enabling a person skilled in the relevant art to make and use the invention.

DETAILED DESCRIPTION OF PREFERRED EMBODIMENTS

Figure 1:
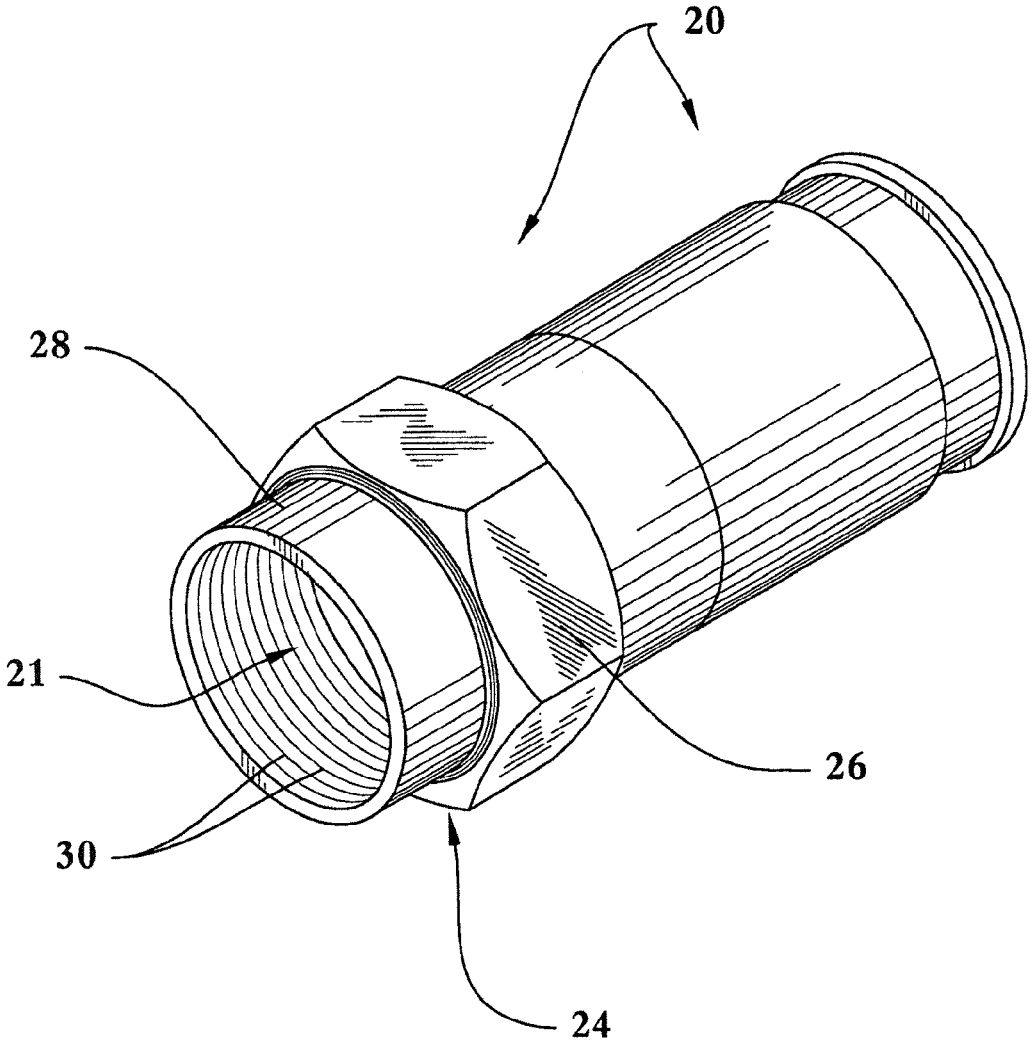
FIG. 1 is a frontal isometric view of a typical coaxial connector in which grounding inserts are used.
Figure 2:
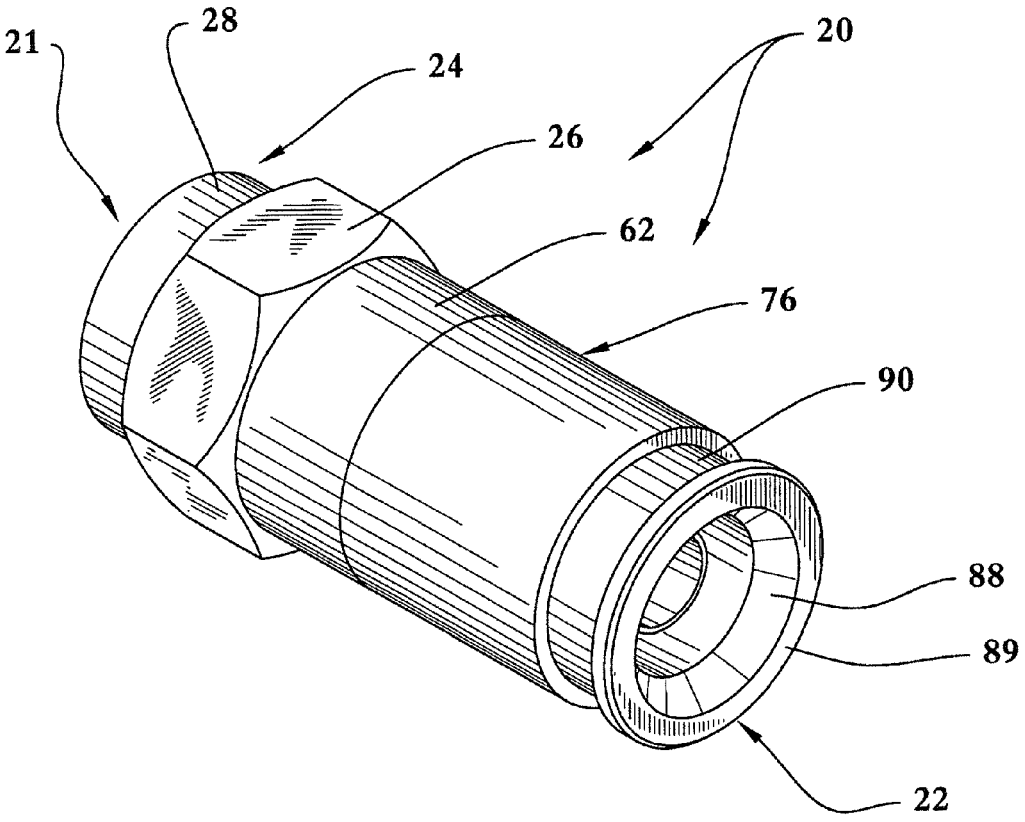
FIG. 2 is a rear isometric view of the connector of FIG. 1.
Figure 3:
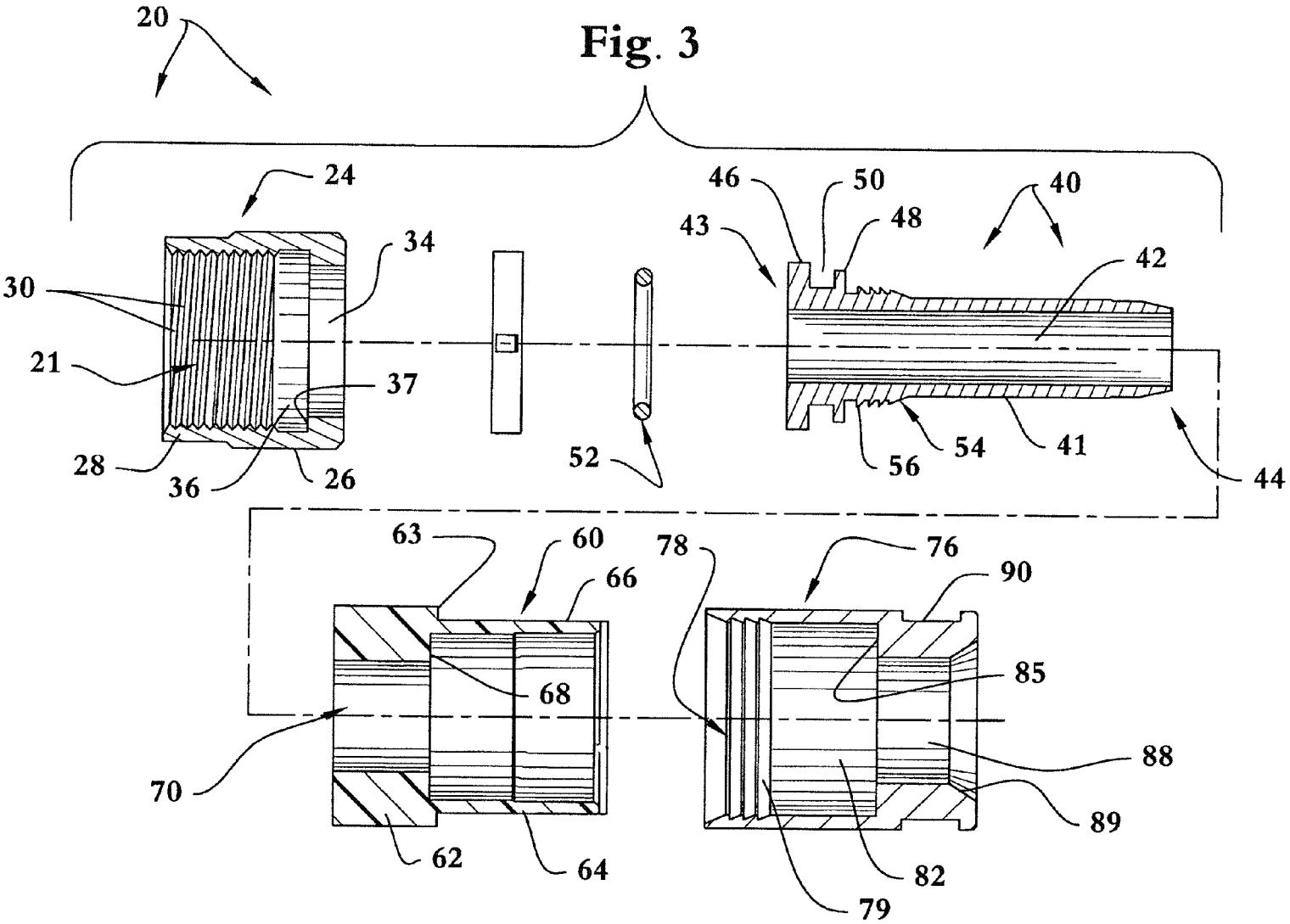
FIG. 3 is an exploded, longitudinal sectional view of the connector of FIGS. 1 and 2 showing the first embodiment of our grounding insert.
Figure 4:
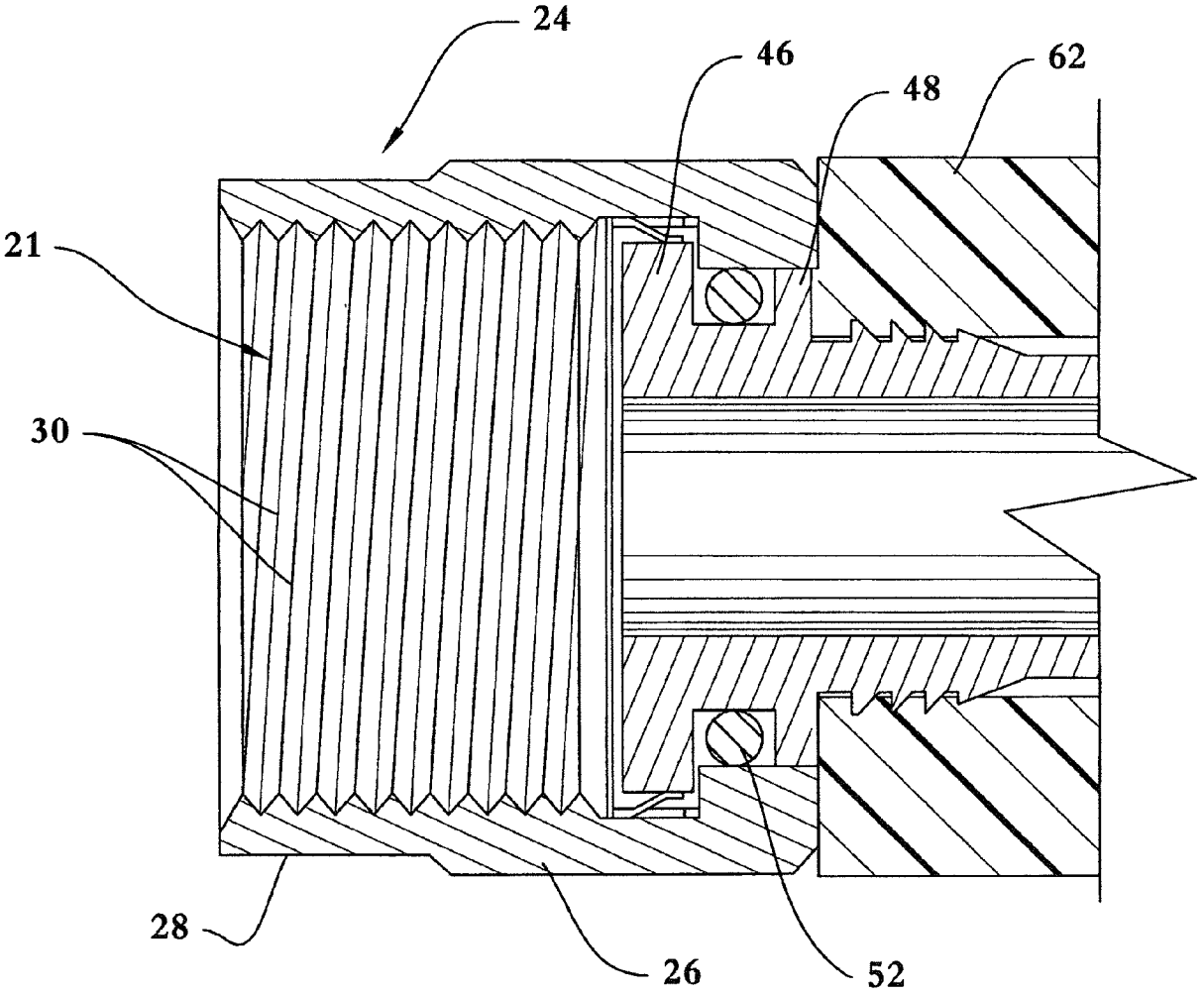
FIG. 4 is an enlarged, fragmentary assembly view of the connector of FIGS. 1-3 showing the first embodiment of our grounding insert, with portions thereof broken away or shown in section for clarity.

Coaxial cable F-connectors are well known in the art. The basic constituents of the coaxial connector of FIGS. 1 and 2 are described in detail, for example, in prior U.S. Pat. No. 7,841,896 entitled "Sealed compression type coaxial cable F-connectors", issued Nov. 30, 2010, and in prior U.S. Pat. No. 7,513,795, entitled "Compression type coaxial cable F-connectors", issued Apr. 7, 2009, which are both owned by the same assignee as in the instant case, and which are both hereby incorporated by reference for purposes of disclosure as if fully set forth herein. However, it will be appreciated by those with skill in the art that coaxial cable connectors of other designs may be employed with the grounding inserts described hereinafter.

Referring initially to FIGS. 1-4 of the appended drawings, a coaxial F-connector has been generally designated by the reference numeral 20. As will be recognized by those skilled in the art, connector 20 is a compressible F-connector, that is axially squeezed together longitudinally when secured to a coaxial cable. As is also recognized in the art, connector 20 is adapted to terminate an end of a properly prepared coaxial cable, which is properly inserted through the open bottom end 22 of the connector 20. Afterwards, the connector is placed within a suitable compression hand tool for compression, assuming the closed configuration of FIGS. 1 and 2 and making electrical contact with the cable.

Connector 20 comprises a rigid, tubular, metallic nut 24 with a conventional faceted, preferably hexagonal drive head 26 integral with a protruding, coaxial stem 28. Nut 24 is torqued during installation. Conventional, internal threads 30 are defined in the stem interior for rotatably, threadably mating with a suitably-threaded socket. The open, tubular front end 21 connects through the open interior to a reduced diameter rear passageway 34 at the back of nut 24. Circular passageway 34 concentrically borders an annular, non-threaded, internal ring groove 36 that borders an internal shoulder 37 (see FIG. 3) proximate passageway 34.

An elongated post 40 rotatably, coaxially passes through the hex headed nut 24. In most F-connector designs the metallic post 40 establishes electrical contact between the braid of the coax and the metallic nut 24. The tubular post 40 defines an elongated shank 41 with a coaxial, internal passageway 42 extending between its front 43 and rear 44. Shank 41 may or may not have barbs formed on it for engaging coaxial cable. A front, annular flange 46 (FIG. 3) is spaced apart from an integral, reduced diameter flange 48, across a ring groove 50. A conventional, resilient O-ring 52 is preferably seated within post groove 50 when the connector 20 is assembled. O-ring 52 is preferably made of a silicone elastomer. A barbed, collar 54 having multiple, external barbs 56 is press fitted into the plastic body 60 described below. In assembly it is noted that post flange 46 (i.e., FIGS. 3, 4) axially contacts inner shoulder 37 (FIG. 4) within nut 24. Inner post flange 48 and the O-ring 52 are coaxially, frictionally disposed within passageway 34 at the rear of nut 24.

The rear tapered end 44 of post shank 41 penetrates the prepared end of the coaxial cable, such that the inner, insulated coaxial cable conductor penetrates passageway 42 and enters the front 21 of the nut 24. Also, the braided shield of the coax is positioned around the exterior of post shank 41, making electrical contact, and hopefully establishing a good ground, or continuity between the coaxial cable sheath, the post 40, and the nut 24.

An elongated, hollow, tubular body 60, normally molded from plastic, is coupled to the post 40. Body 60 preferably comprises a tubular stop ring 62 that is integral with a reduced diameter body shank 64. The elongated, outer periphery 66 of shank 64 is smooth and cylindrical. The larger diameter stop ring 62 has an annular, rear wall 68 that is coaxial with shank 64. Ring 62 defines an internal passageway 70 through which the post 40 is inserted. In assembly, the barbed post collar 54 is frictionally seated within body passageway 70.

An end cap 76 is pressed unto body 60, coaxially engaging the body shank 64. The rigid, preferably metallic end cap 76 smoothly, frictionally grips body shank 64, with maximum travel or displacement limited by stop ring 62. In other words, when the end cap 76 is compressed unto the body 60, and the connector 20 assumes a closed position (i.e., FIG. 2), annular wall 63 on the body stop ring 62 will limit deflection or travel of the end cap 76. Preferably the open end 78 of the end cap includes internally barbed region 79 that couples to the shank 64 of the body 60. When the body 60 and the cap 76 are compressed together, body travel is limited within cap passageway 82 by contact with internal cap shoulder 85. The reduced diameter passageway 88 is sized to receive coaxial cable, which is inserted through the flared opening 89. An outer ring groove 90 at the cap rear can seat a desired O-ring.

In most F-connectors, grounding or continuity is established by mechanical and electrical contact points between abutting, conductive, metallic parts. Noting FIGS. 3 and 4, for example, normal grounding should occur between nut shoulder 37 and post flange 46. The coaxial cable sheath bearing against the post shank 41 would thus electrically interconnect with the post and the nut 24, which would in turn establish electrical contact with the socket to which nut 24 is attached. However, grounding or continuity depend on proper tightening of the nut 24. In the real world, installers often neglect to properly tighten the nut, so less internal, mechanical pressure is available within the F-connector to urge the parts discussed above into abutting, conductive contact.

Figure 7:
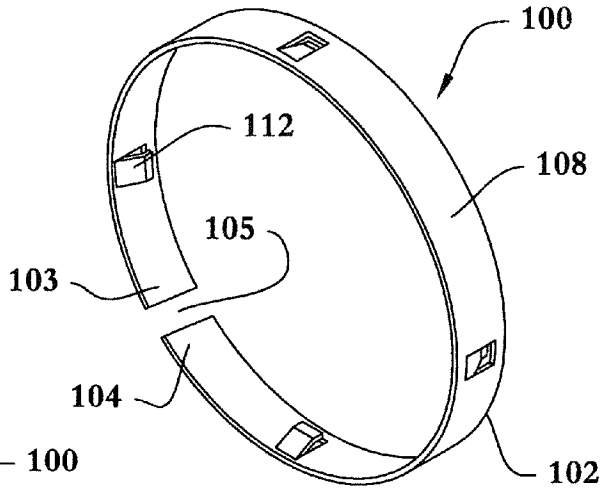
FIG. 7 is an enlarged, isometric view of the grounding insert of FIGS. 3-6.
Figure 6:
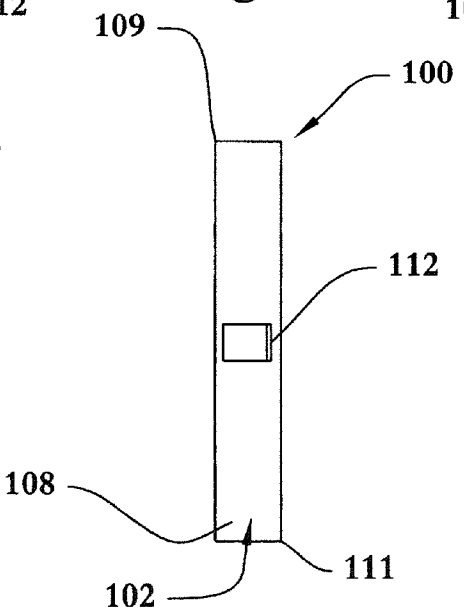
FIG. 6 is an enlarged, side elevational view of the grounding insert of FIGS. 3-5.
Figure 5:
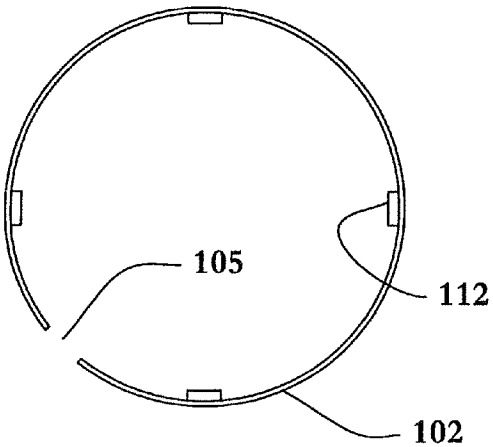
FIG. 5 is an enlarged end view of a first embodiment of our grounding insert.
Figure 8:
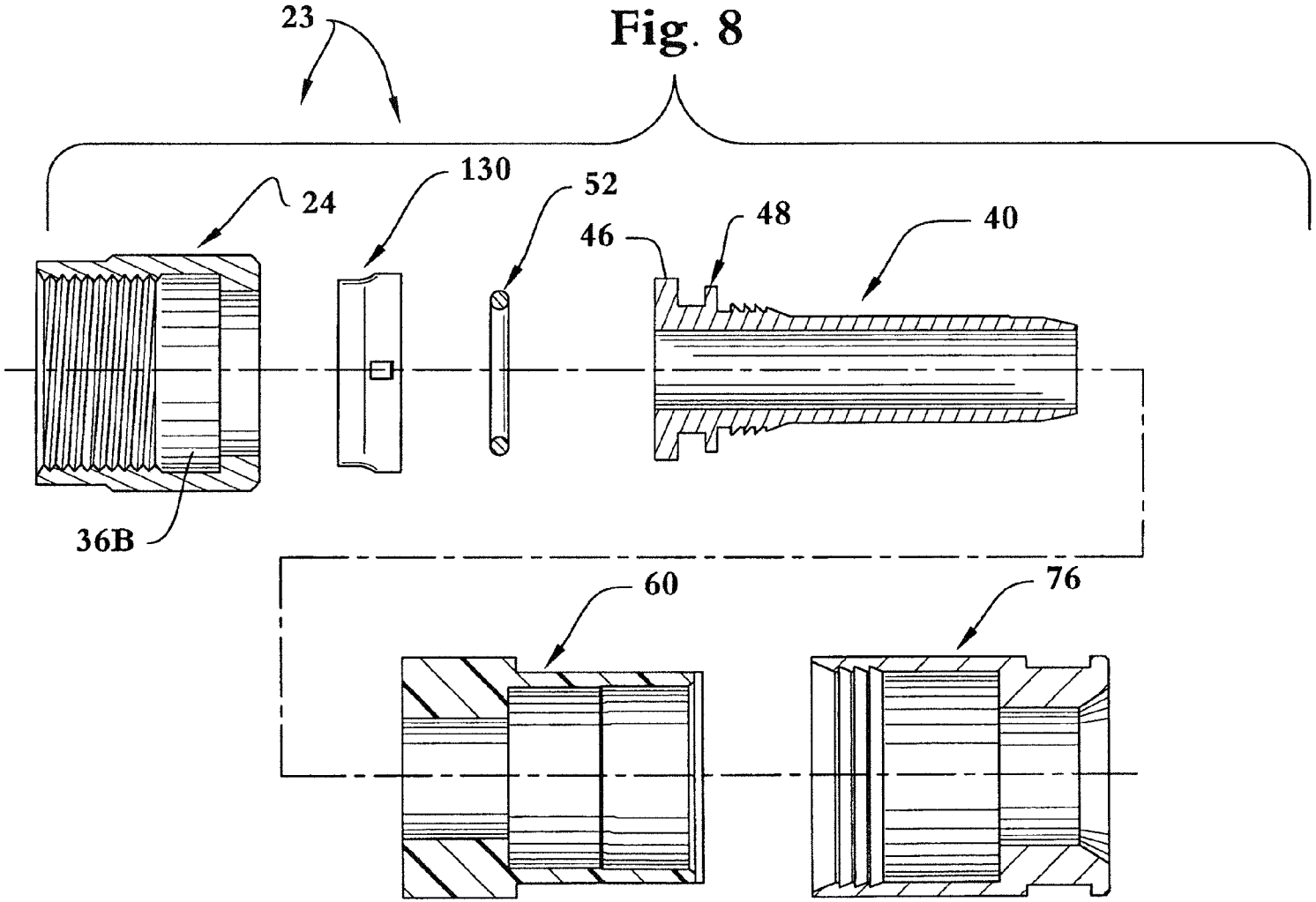
FIG. 8 is an exploded, longitudinal sectional view of a connector such as that of FIGS. 1-2, showing the second embodiment of our grounding insert.
Figure 9:
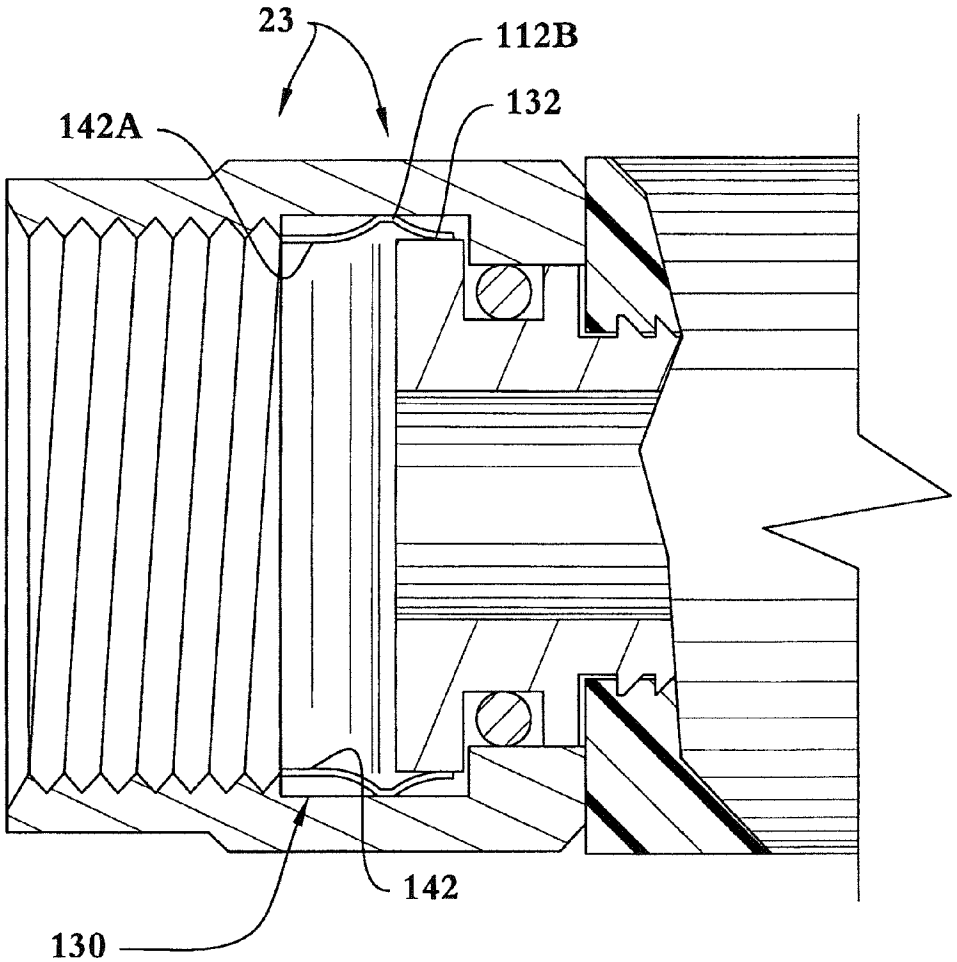
FIG. 9 is an enlarged, fragmentary assembly view showing the grounding insert of FIG. 8, with portions thereof broken away or shown in section for clarity.
Figure 11:
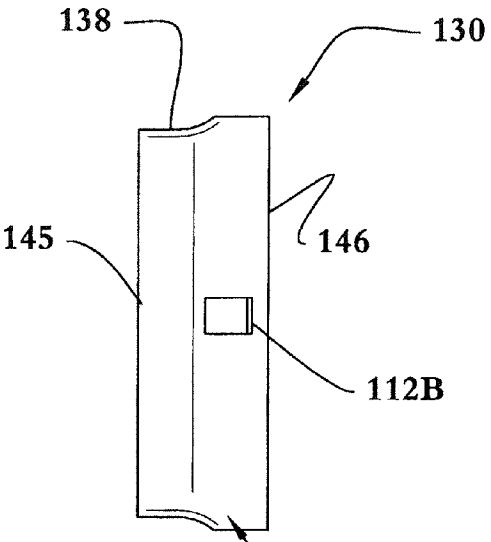
FIG. 11 is a side elevational view of the second embodiment of our grounding insert.
Figure 12:
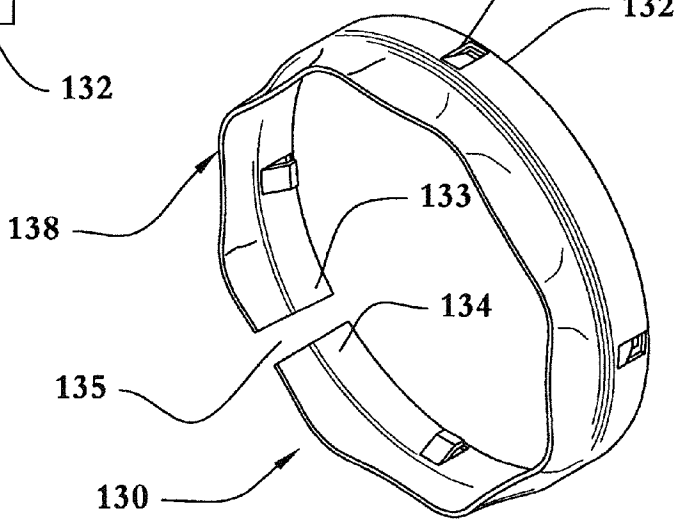
FIG. 12 is an isometric view of the second embodiment of out grounding insert of FIGS. 10 and 11.

Therefore our electrical grounding inserts have been proposed. The first embodiment of our insert is generally designated by the reference numeral 100 (FIGS. 5-7.)

Ground insert 100 comprises an annular, circular band 102 of beryllium copper alloy. Means are provided for contacting and grasping the post flange, and for contacting the nut interior. Insert ends 103 and 104 border one another across a gap 105. As best viewed in FIG. 6, the band midsection 108 is substantially equal in diameter to the opposite, integral spaced apart band edges 109 and 111. It will be noted that a plurality of radially, spaced apart clips 112 are formed at regular intervals along the circumference of the band 102. Preferably clips 112 project inwardly towards the center of the band 102.

In assembly, the grounding insert 100 coaxially surmounts the post 40. Specifically, the band 102 coaxially seats upon post flange 46 which is securely grasped at multiple points by the clips 112. Insert resilience is provided by a combination of the natural "springiness" of the beryllium copper alloy, the gap 105, and the multiple clips 112 that yieldably grasp the periphery of post flange 46. Electrical contact between the insert and the post is thus insured by clips 112. Electric contact between the insert 100 and the nut 24 is insured by the band 102 coaxially seated within annular ring groove 36 (FIG. 3) and the clip end 111 (FIG. 6) that internally abuts nut shoulder 37 (i.e., FIGS. 3, 4).

The alternative embodiment is seen in FIGS. 8-12. Alternative F-connector 23, is externally identical with connector 20, discussed above. However, connector 23 includes a modified grounding insert 130 described hereinafter. Like connector 20, the alternative connector 23 comprises a nut 24, a post 40, a body 60 and an end cap 76, all of which are described above.

Figure 10:
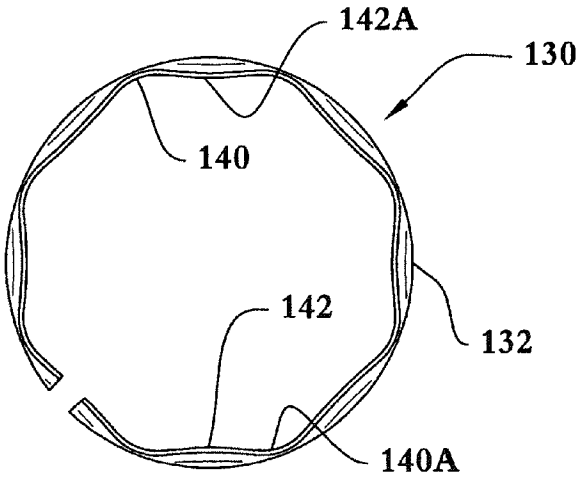
FIG. 10 is an end view of the second embodiment of our grounding insert.

Ground insert 130 comprises means for contacting and grasping the post flange, and for contacting the nut interior. Insert 130 comprises a tubular band 132 of beryllium copper alloy for contacting and grasping the post flange. The cross section of insert 130 is circular. Ends 133 and 134 border one another across a gap 135. Band 132 is integral with a flared, skirt 138 characterized by a polygonal cross section (FIG. 10). Like a regular polygon, skirt 138 comprises a plurality of vertices 140 and a plurality of facets 142. The diameter of skirt 138 is maximum, and equal to the diameter of band 132, between opposed vertices (i.e., between vertices 140 and 140A in FIG. 10). The gently curved facets establish a smaller internal diameter. For example, the distance between opposite facets 142 and 142A in FIG. 10, corresponding to minimal skirt diameter, is less than the distance between vertices 140 and 140A.

Preferably, band 132 is provided with a plurality of radially, spaced apart clips 112B like clips 112 previously described that are defined around insert 100. In assembly, clips 112B make contact with the post flange 46 within the ring groove 36B.

In assembly (FIG. 9), the front 145 of grounding insert 130 points exteriorly of the connector 23 towards nut 24. The insert rear 146 (FIG. 11) points inwardly. Band 132 coaxially seats upon a post flange 46 and yieldably grasps the periphery of the flange to establish electrical contact with the post. In assembly, band 132 occupies space between flange post 46 and internal annular ring groove 36 in nut 24. Skirt vertices 140 abut the annular ring groove 36B (i.e., FIGS. 8, 9) in the nut. It is to be noted that ring groove 36B is longer than similar groove 36 in connector 20, as the insert 130 is longer than insert 100.

Figure 13:
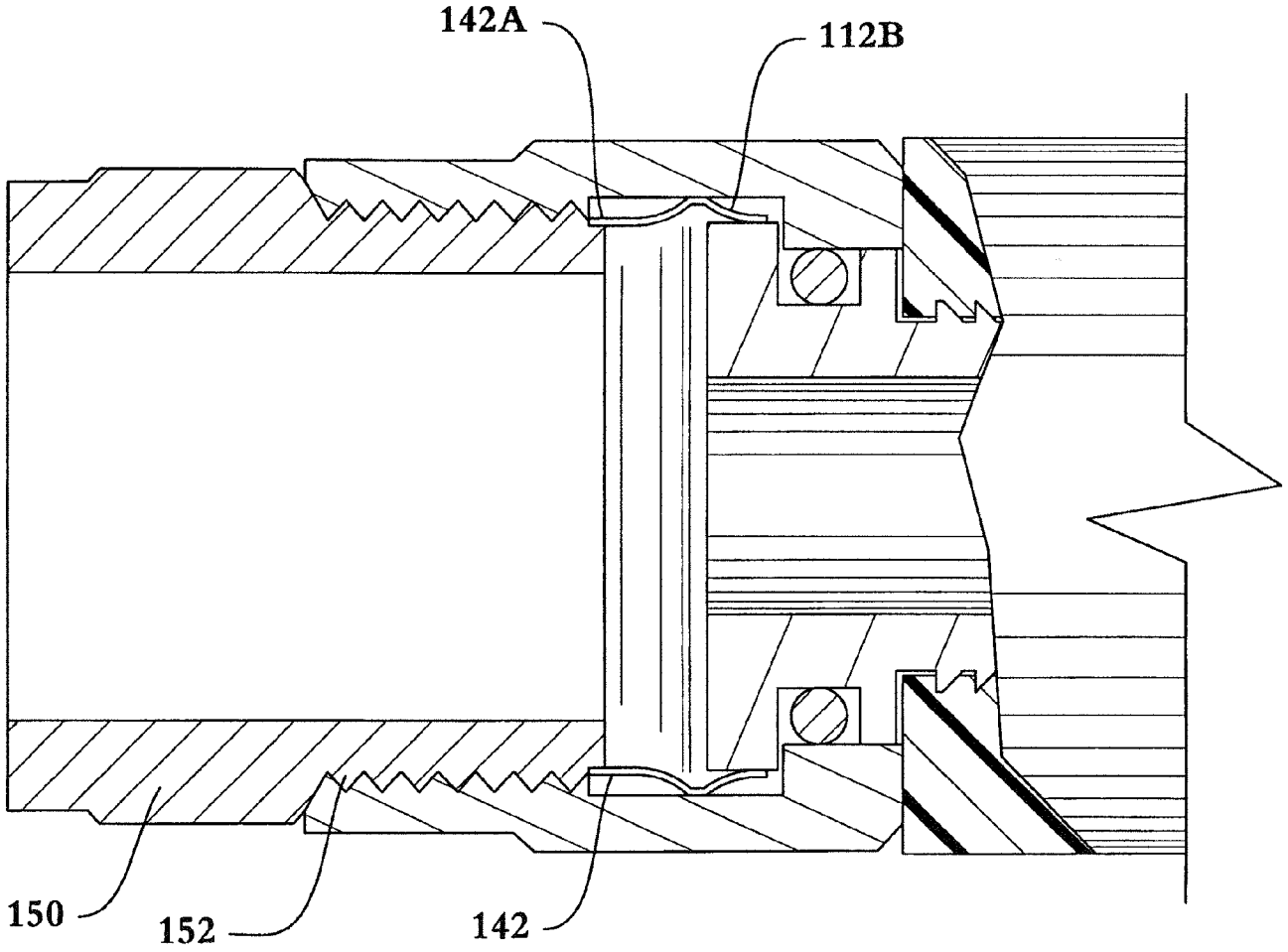
FIG. 13 is an enlarged sectional view similar to FIG. 9, but showing the connector threadably mated to a threaded socket.

Further electrical continuity is established by skirt contact with the socket or terminal to which the connector is coupled. Referencing FIG. 13, the connector has engaged a conventional socket 150 that includes the typical external threads 152. When the connector is attached, the skirt facets, such as facets 142, 142A will externally contact a portion of the socket threads to help establish continuity between the socket 152 and the connector.

Insert resilience is provided by a combination of the natural "springiness" of the beryllium copper alloy, the gap 135, and the multiple facets 142 and vertices 140 of the skirt configuration. Electrical contact between the insert 130 and the post 40 is thus insured. Electric contact between the insert 130 and the nut 24 is also maintained.

Turning now to FIGS. 14A-E, use of a first polygonal grounding insert 1400A-E is shown. Similar to the connector parts described above, parts of a connector such as an F-Type coaxial cable connector include a nut 241, a post 401, and grounding member 1402. In some embodiments, first and second post flanges 461, 481 define a ring groove therebetween 501 near a post front end 431. When assembled, the nut encircles the post flanges and the grounding insert is interposed between the post and the nut.

Figure 14B:
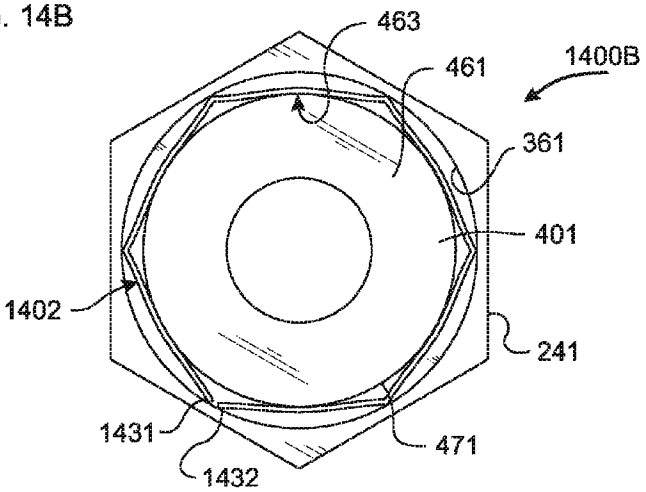
FIGS. 14A-D illustrate a first polygonal grounding insert.
Figure 14D:
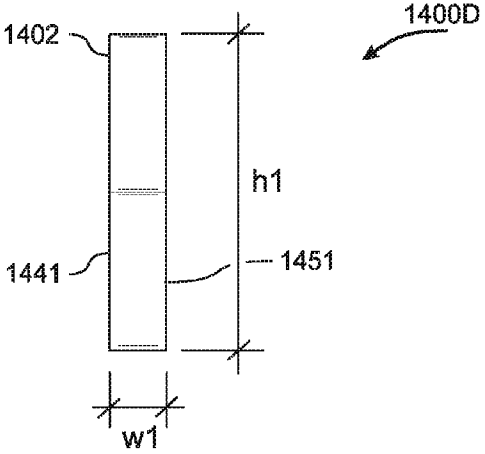
Figure 14A:
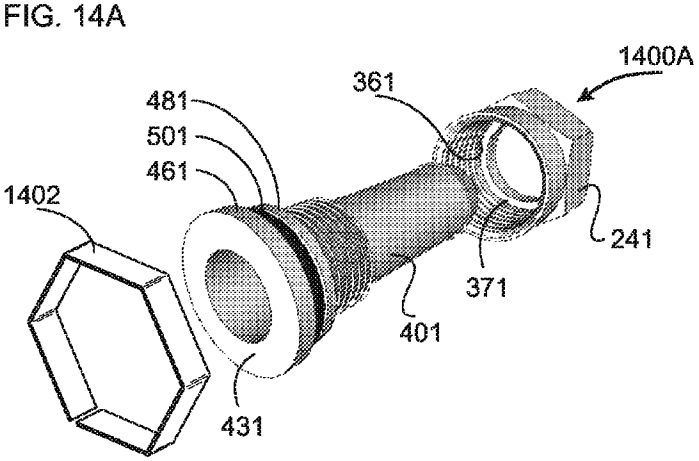
Figure 14C:
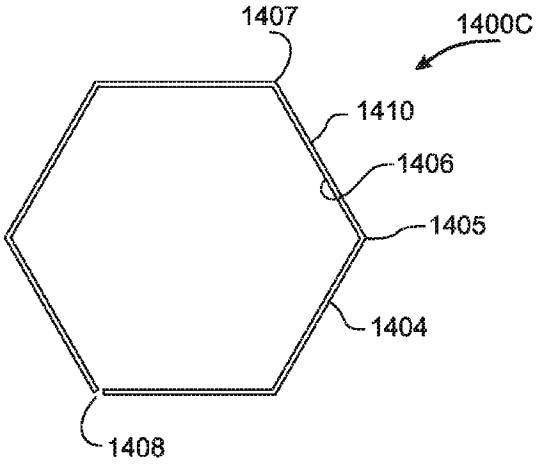

FIGS. 14C and 14D show insert end and side views respectively 1400C, 1400D. As shown in the end view, the insert 1402 has a generally polygonal cross-section and as shown in the side view, the insert has a width "w1" and a height "h1." In various embodiments w1 is selected such that the insert is accommodated by the nut internal ring groove 361.

This first polygonal grounding insert 1402 has three (3) or more sides (six are shown), each side being formed between adjacent corners such as rounded or angular corners. For example, a side 1410 is located between adjacent corners 1405, 1407 and each side includes outer and inner side surface 1404, 1406. In some embodiments, the insert cross-section is broken 1408, for example broken at a corner (as shown). And, in some embodiments the insert cross-section is continuous with no break (not shown).

FIG. 14B shows an end view of the assembled connector parts 1400B. Here, the insert 1402 encircles a post flange such as the forward post flange 461. In various embodiments, the insert is configured to grasp a post flange periphery such as a radial periphery 471 of the forward post flange 461. And, in various embodiments, the insert conforms to a portion of the post 463.

Figure 14E:
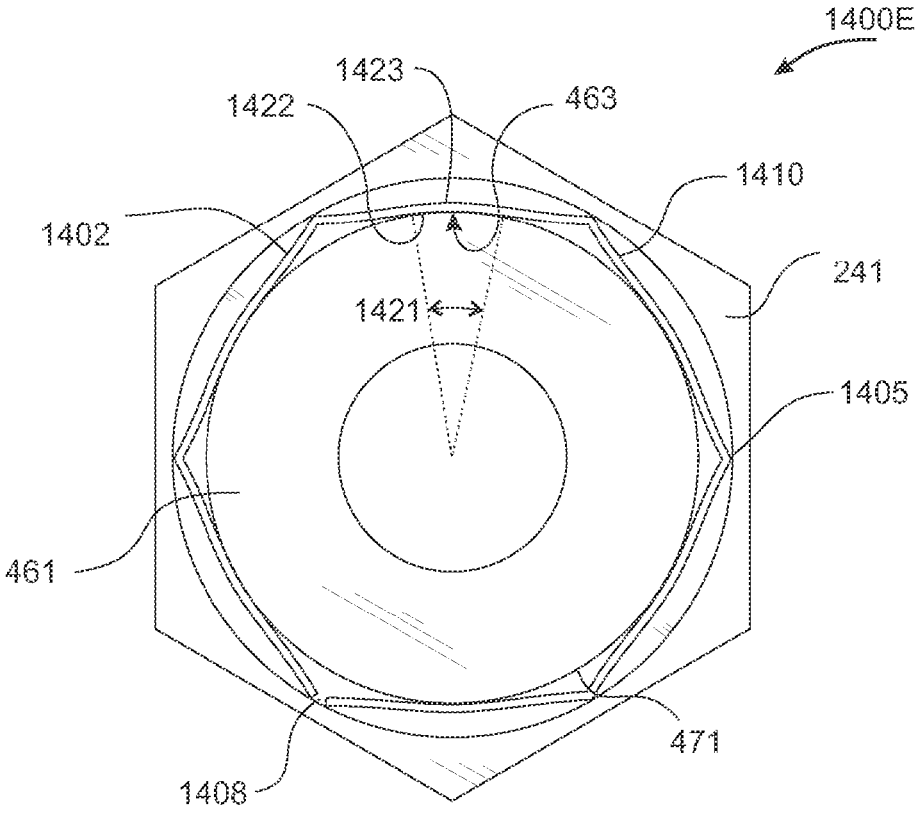
FIG. 14E shows an enlarged view of FIG. 14B.

Referring also to FIG. 14E, a six sided insert 1400E has six sides 1410 and six corners 1405 forming substantially a six sided polygon with a break in the insert at one of the corners 1408. Post chamfering and/or insert flaring may be used to ease assembly of the insert onto the radial periphery 471 of the forward post flange 461. In various embodiments, the insert break 1408 opens up as the insert is fitted to the post flange and central portions 1423 of insert sides bulge from force exerted by a mating arc-shaped segment of the post 1422 indicated by an angle 1421.

As skilled artisans will appreciate, electrically conductive inserts provide a ground path between the post and the nut when portion(s) of the insert contact the nut and the post. For example, one or more of insert inner surfaces 1406 and edges 1441, 1451 contact the post 401 and one or more of insert outer surfaces 1404 and edges 1441, 1451 contact the nut 241 completing an electrical circuit between the post and the nut. In various embodiments, insert corners 1405 contact the nut such as contact with a nut cylindrical inner face 361 adjacent to a nut inner annular shoulder 371. As shown, some embodiments provide for insert end 1431, 1432 contact with the nut, for example at the nut groove 361.

In another embodiment, FIGS. 15A-F include use of a second polygonal grounding insert 1500A-F. Similar to the connector parts described above, parts of a connector such as an F-Type coaxial cable connector include a nut 241, a post 401, and grounding member 1502. In some embodiments, first and second post flanges 461, 481 define a ring groove therebetween 501 near a post front end 431. When assembled, the nut encircles the post flanges and the grounding insert is interposed between the post and the nut.

Figure 15B:
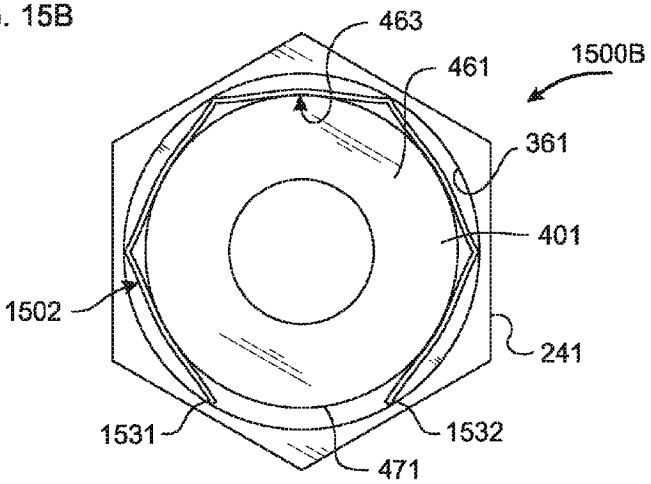
FIGS. 15A-D illustrate a second polygonal insert.
Figure 15D:
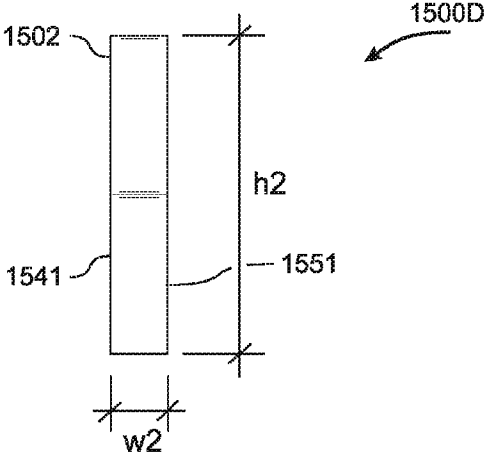
Figure 15A:
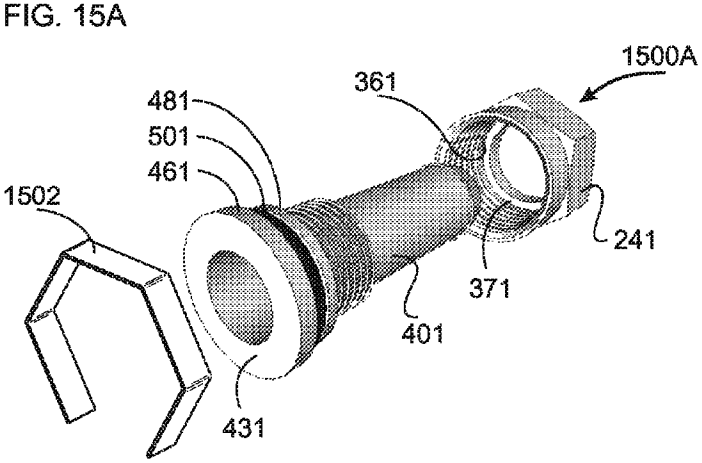
Figure 15C:
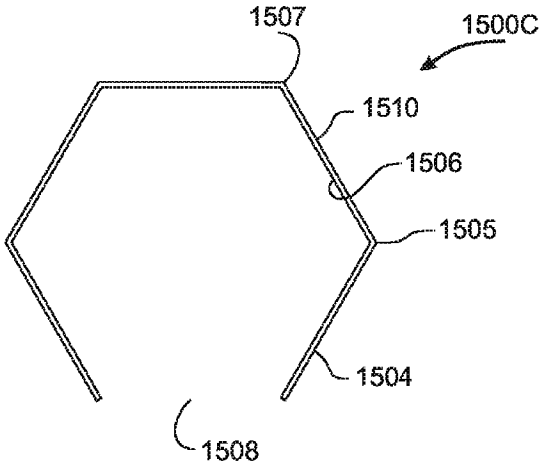

FIGS. 15C and 15D show insert end and side views respectively 1500C, 1500D. As shown in the end view, the insert 1502 has a generally polygonal cross-section and as shown in the side view, the insert has a width "w2" and a height "h2." In various embodiments w2 is selected such that the insert is accommodated by the nut internal ring groove 361.

This first polygonal grounding insert 1502 has three (3) or more sides together with an open side 1508 (five sides plus an open side are shown). Each side is formed between adjacent corners such as rounded or angular corners. For example, a side 1510 is located between adjacent corners 1505, 1507 and each side includes outer and inner side surface 1504, 1506.

FIG. 15B shows an end view of the assembled connector parts 1500B. Here, the insert 1502 encircles a post flange such as the forward post flange 461. In various embodiments, the insert is configured to grasp a post flange periphery such as a radial periphery 471 of the forward post flange 461. And, in various embodiments, the insert conforms to a portion of the post 463 in a manner similar to that described in connection with FIG. 14E.

As skilled artisans will appreciate, electrically conductive inserts provide a ground path between the post and the nut when portion(s) of the insert contact the nut and the post. For example, one or more of insert inner surfaces 1506 and edges 1541, 1551 contact the post 401 and one or more of insert outer surfaces 1504 and edges 1541, 1551 contact the nut 241 completing an electrical circuit between the post and the nut. In various embodiments, insert corners 1505 contact the nut such as contact with a nut cylindrical inner face 361 adjacent to a nut inner annular shoulder 371. As shown, some embodiments provide for insert end 1531, 1532 contact with the nut, for example at the nut groove 361.

Figure 15E:
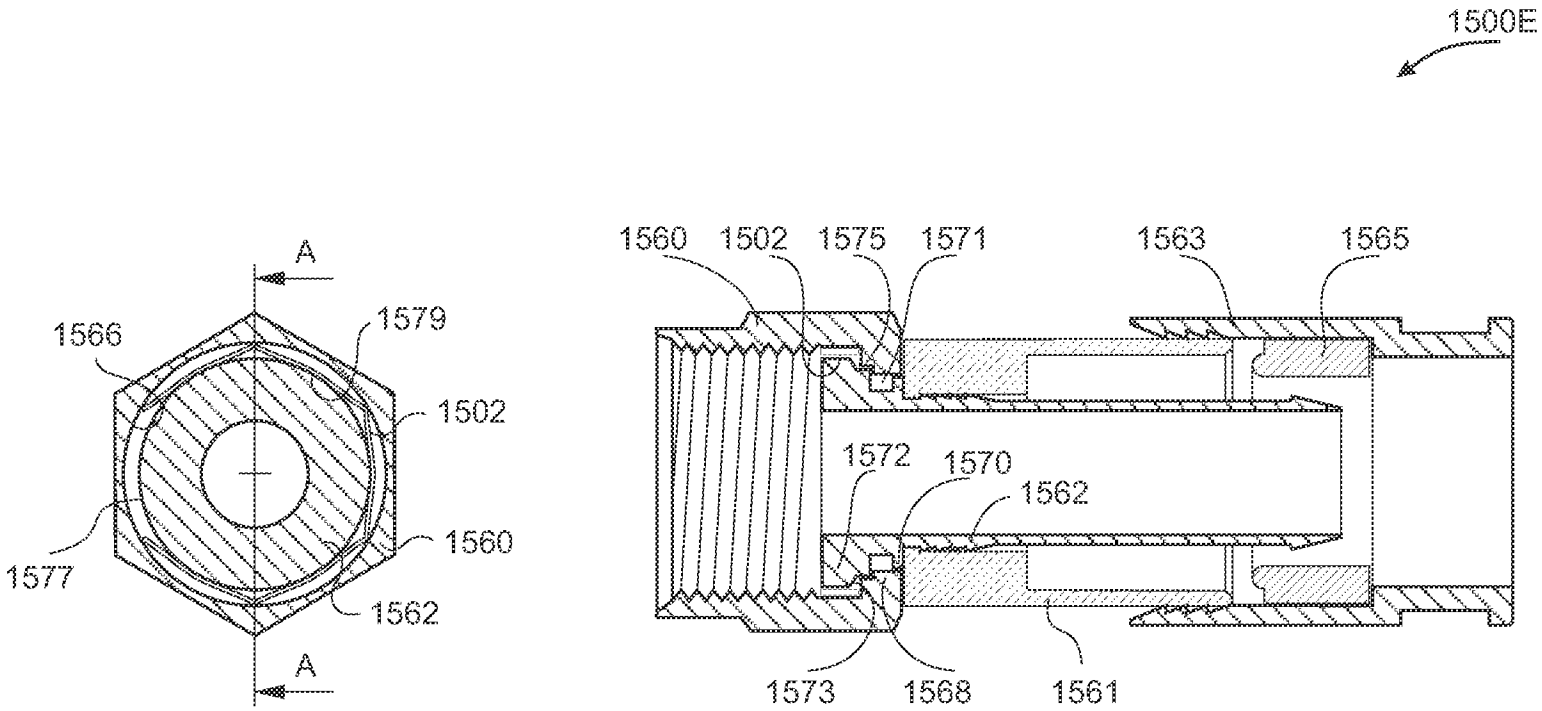
FIG. 15E shows the grounding insert of FIG. 15C installed in a first connector.

FIG. 15E shows a second polygonal grounding insert installed in a male F-Type connector 1500E. The connector includes a fastener or nut 1560, a post 1562, a body 1561, an outer shell 1563, and a cable fixation plug 1565. The grounding insert 1502 is located by a ring groove 1566 of the nut.

As shown, a forward end of the post includes a first stepped flange 1572 and a spaced apart second flange 1570, and a post groove 1571 therebetween. A nut rear annular wall 1568 engages the stepped flange and spans across the post groove. In some embodiments, a leading right angle corner of the nut annular wall 1575 is adjacent to and/or abuts a sloped flange step 1573. Electrical conductivity between the nut and the post is enhanced by use of an electrically conductive grounding insert that contacts both the nut and the post. For example, as described in connection with FIGS. 15A-D above and/or when corners of the insert contact the nut ring groove 1566 while inside surfaces of the insert 1579 contact a radial periphery 1577 of the post flange 1572.

Figure 15F:
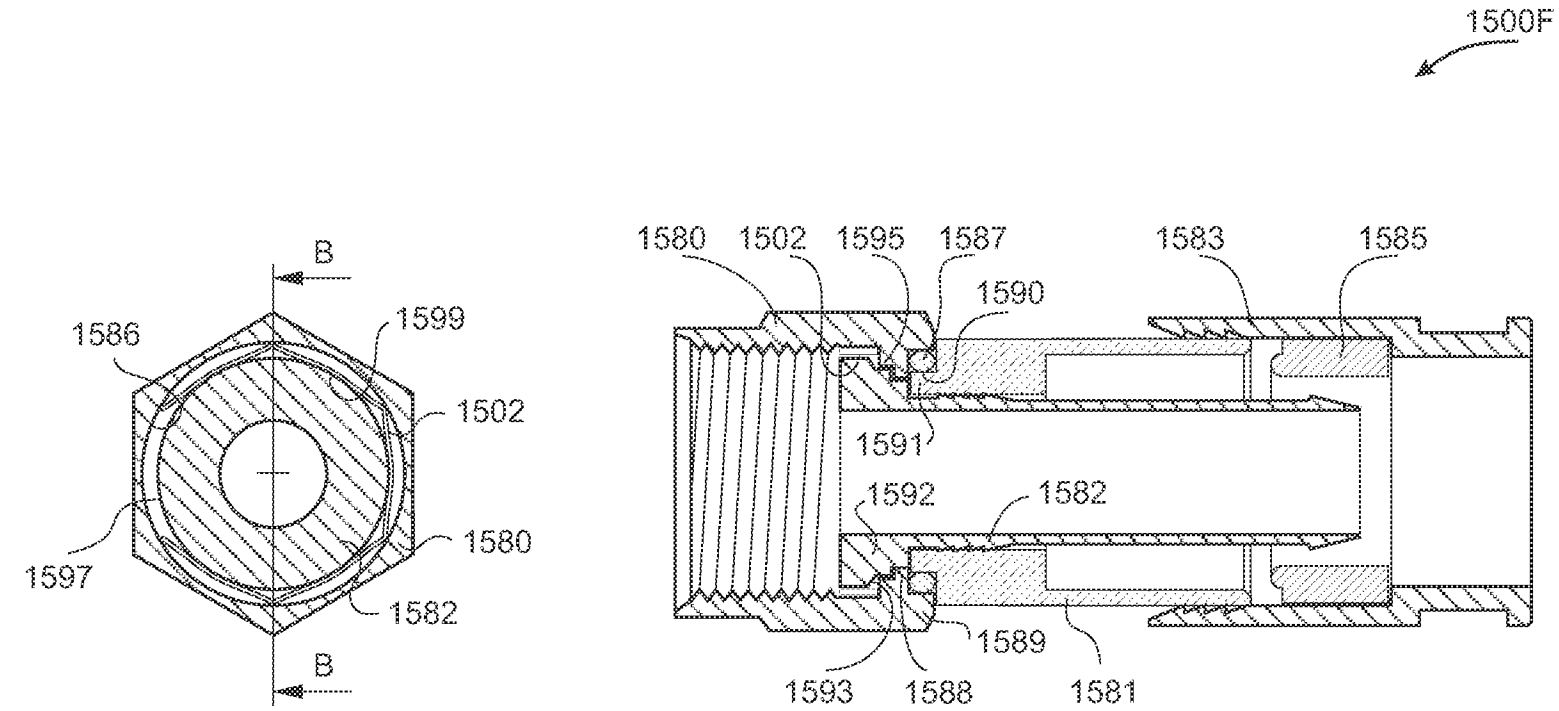
FIG. 15F shows the grounding insert of FIG. 15C installed in a second connector.

FIG. 15F shows a second polygonal grounding insert installed in another male F-Type connector 1500F. The connector includes a fastener or nut 1580, a post 1582, a body 1581, an outer shell 1583, and a cable fixation plug 1585. The grounding insert 1502 is located by a ring groove 1586 of the nut.

As shown, a forward end of the post includes a stepped flange 1592. A nut internal annular wall 1588 engages the stepped flange and a nut trailing hood 1589 overhangs a body end shoulder 1591 to form a cavity 1590, for example a cavity for locating a seal such as an O-Ring seal 1587 that seals between the nut hood and the body shoulder. In some embodiments, a leading right angle corner of the nut annular wall 1595 is adjacent to and/or abuts a sloped flange step 1593. Embodiments enhance electrical conductivity between the nut and the post using an electrically conductive grounding insert that contacts both the nut and the post. For example, as described in connection with FIGS. 15A-D above and/or when corners of the insert contact the nut ring groove 1586 while inside surfaces 1599 of the insert contact a radial periphery 1597 of the post flange 1592.

As skilled artisans will appreciate, the connectors of FIGS. 15E-F may, in other embodiments, incorporate other ones of the grounding inserts described herein.

In another embodiment, FIGS. 16A-D use of a first cylindrical grounding insert with transverse tabs 1600A-D. Similar to the connector parts described above, parts of a connector such as an F-Type coaxial cable connector include a nut 241, a post 401, and grounding member 1602. In some embodiments, first and second post flanges 461, 481 define a ring groove therebetween 501 near a post front end 431. When assembled, the nut encircles the post flanges and the grounding insert is interposed between the post and the nut.

Figure 16B:
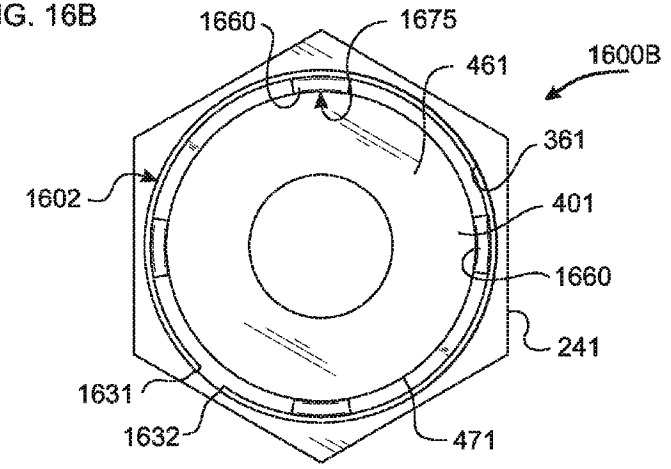
FIGS. 16A-D illustrate a first transverse tab cylindrical insert.
Figure 16D:
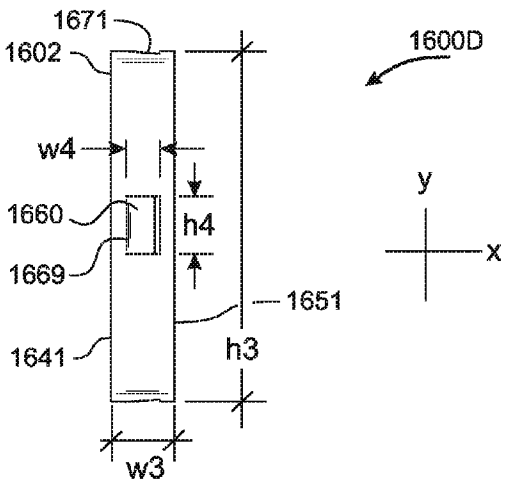
Figure 16A:
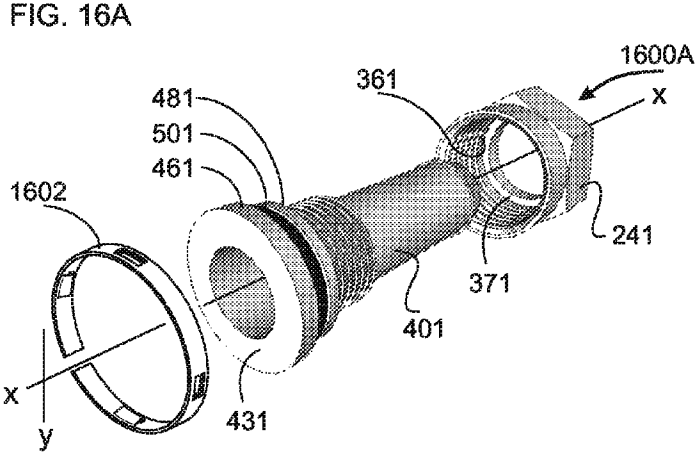
Figure 16C:
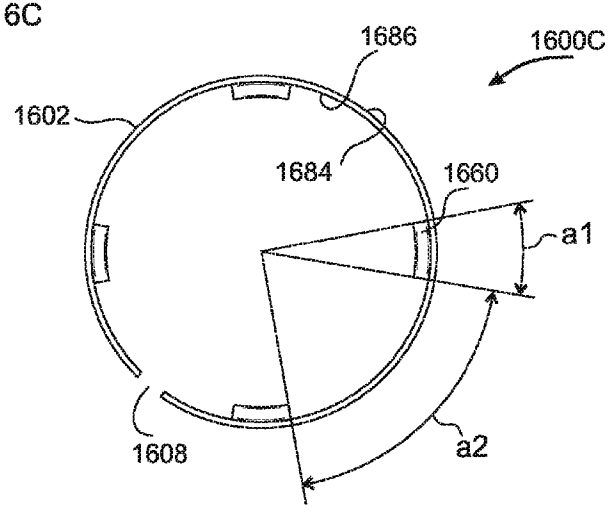

FIGS. 16C and 16D show insert end and side views respectively 1600C, 1600D. In the end view, outer and inner band sides 1684, 1686 are shown. And, as shown in the end view, the insert 1602 has a generally circular cross-section and as shown in the side view, the insert has a width "w3" defined by edges 1641 and 1651 and a height "h3." In various embodiments w3 is selected such that the insert is accommodated by the nut internal ring groove 361. In some embodiments, the insert cross-section is broken 1608 (as shown). And, in some embodiments the insert cross-section is continuous with no break (not shown).

This first cylindrical grounding insert 1602 has a width w3 a height h3, and includes a plurality of transverse tabs 1660 (four shown). As shown in FIGS. 16C-D, the tabs are transverse with respect to adjacent grounding insert edges 1641, 1651 of the grounding insert and transverse with respect to a connector radial or y-y axis.

As shown in FIGS. 16C-D, the tabs are transverse with respect to grounding insert edges 1641, 1651 and are evenly spaced around an insert circumference. In various embodiments, the tabs extend toward the axis and in various embodiments the tabs extend away from the axis.

As shown, the insert tabs 1660 extend toward the x-x axis. While generally rectangular tabs are shown, any suitable shape may be selected. For example, a tab shape may be selected to mate with a particular post shape such as a generally cylindrical post flange peripheral face 471. As shown, a rectangular tab 1660 shape is formed when the rectangular tab is severed from adjacent material along three sides leaving a fourth un-severed side or bend line 1669 that supports the tab.

Tabs 1660 may be evenly spaced or irregularly spaced around the insert 1602 circumference. Tab width w4 is limited by insert width w3 while tab height h4 is influenced by required tab deflection 1671 and resilience given insert material geometry and properties. In the embodiment of FIG. 16C, tabs have a circumferental measure indicated by angle "a1" and tabs are separated by an angle "a2" such that four tabs are evenly arranged around the circumference of the insert.

FIG. 16B shows an end view of the assembled connector parts 1600B. Here, the insert 1602 encircles a post flange such as the forward post flange 461. In various embodiments, the insert is configured to grasp a post flange periphery such as a radial periphery 471 of the forward post flange 461. And, in various embodiments, the tabs conform with a portion of the post 1675.

Referring to FIG. 16C, the circular insert 1600C provides a means for a somewhat circular engagement and is severed along a transverse line to create a break 1608. The break enables the band to resiliently open and close about a mating object encircled by the insert. Post chamfering and/or insert flaring may be used to ease assembly of the insert onto the radial periphery 471 of the forward post flange 461. In various embodiments, the insert break 1608 opens up as the insert is fitted to the post flange and the insert tabs contact and exert a force on post portions such as the radial periphery of the forward post flange 471.

As skilled artisans will appreciate, electrically conductive inserts provide a ground path between the post and the nut when portion(s) of the insert contact the nut and the post. For example, one or more of tabs 1660 contact the post 401 and while insert outer surface(s) 1684 contact the nut 241 and complete an electrical circuit between the post and the nut. In some embodiments, insert edges 1641, 1651 contact one or more parts of the connector such as the nut inner shoulder 371 adjacent to the nut inner groove 361. And, in some embodiments, insert ends 1631 and 1632 contact the nut as shown in FIG. 16B.

In another embodiment, FIGS. 17A-D show a second cylindrical grounding insert with transverse tabs 1700A-D. Similar to the connector parts described above, parts of a connector such as an F-Type coaxial cable connector include a nut 241, a post 401, and grounding member 1702. In some embodiments, first and second post flanges 461, 481 define a ring groove therebetween 501 near a post front end 431. When assembled, the nut encircles the post flanges and the grounding insert is interposed between the post and the nut.

Figure 17B:
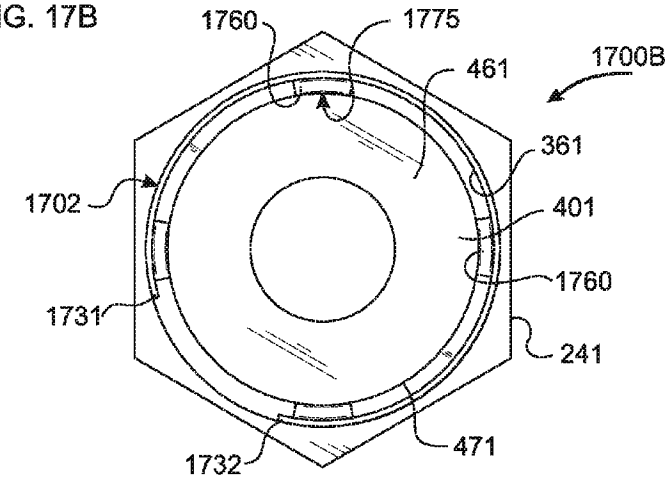
FIGS. 17A-D illustrate a second transverse tab cylindrical insert.
Figure 17A:
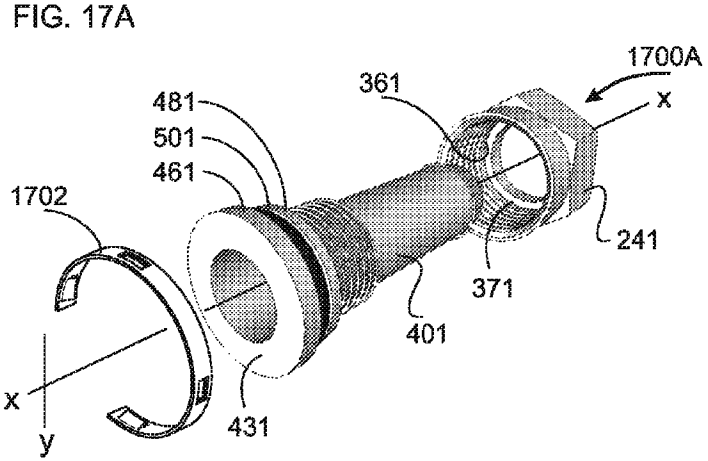
Figure 17D:
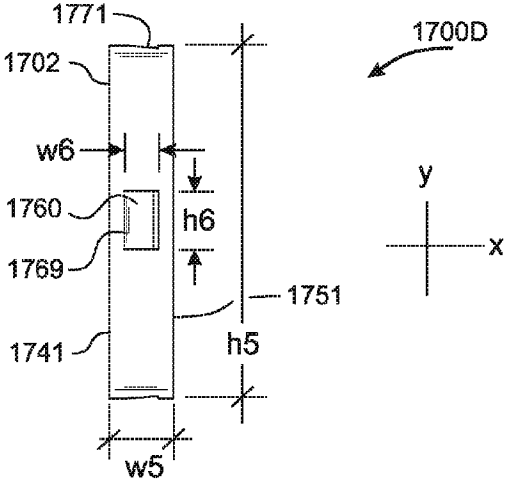
Figure 17C:
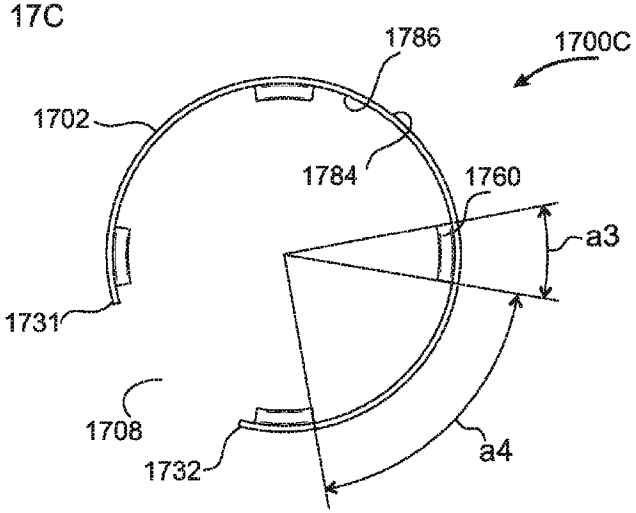

FIGS. 17C and 17D show insert end and side views respectively 1700C, 1700D. As shown in the end view, the insert 1702 has a generally circular cross-section and as shown in the side view, the insert has a width "w5" defined by edges 1741 and 1751 and a height "h5." In various embodiments w5 is selected such that the insert is accommodated by the nut internal ring groove 361. In some embodiments, the insert cross-section is broken 1708, for example broken at a corner exposing opposed insert ends 1731, 1732 (as shown). And, in some embodiments the insert cross-section is continuous with no break (not shown).

This first cylindrical grounding insert 1702 has outer and inner sides 1784, 1786, a width w5, a height h5, and includes a plurality of transverse tabs 1760 (four shown). As shown in FIGS. 17C-D, the tabs are transverse with respect to the edges 1741, 1751 of the grounding insert and transverse with respect to a connector radial or y-y axis. In various embodiments, the tabs extend toward the x-x axis and in various embodiments the tabs extend away from the x-x axis.

As shown, the insert tabs 1760 extend toward the x-x axis. While generally rectangular tabs are shown, any suitable shape may be selected. For example, a tab shape may be selected to mate with a particular post shape such as a generally cylindrical post flange peripheral face 471. As shown, a rectangular tab 1760 shape is formed when the rectangular tab is severed from adjacent material along three sides leaving a fourth un-severed side or bend line 1769 that supports the tab.

Tabs 1760 may be evenly spaced or irregularly spaced around the insert 1702 circumference. Tab width w6 is limited by insert width w5 while tab height h6 is influenced by required tab deflection 1771 and resilience given insert material geometry and properties. In the embodiment of FIG. 17C, tabs have a circumferental measure indicated by angle "a3" and tabs are separated by an angle approximated as "a4" such that four tabs are evenly arranged around the circumference of the insert.

FIG. 17B shows an end view of the assembled connector parts 1700B. Here, the insert 1702 encircles a post flange such as the forward post flange 461. In various embodiments, the insert is configured to grasp a post flange periphery such as a radial periphery 471 of the forward post flange 461. And, in various embodiments, the tabs contact a portion of the post 1775.

Referring to FIG. 17C, the circular insert 1700C provides a means for a somewhat circular engagement and is severed along a transverse line to create a gap 1708. As shown, a measure of the gap is approximated by angle a4 measured between adjacent tabs. This gap enables the band to resiliently expand and contract about a mating object encircled by the insert. Post chamfering and/or insert flaring may be used to ease assembly of the insert onto the radial periphery 471 of the forward post flange 461. In various embodiments, the insert gap 1708 opens up as the insert is fitted to the post flange and the insert tabs contact and exert a force on post portions such as the radial periphery of the forward post flange 471.

As skilled artisans will appreciate, electrically conductive inserts provide a ground path between the post and the nut when portion(s) of the insert contact the nut and the post. For example, one or more of tabs 1760 contact the post 401 and while insert outer surface(s) 1784 contact the nut 241 and complete an electrical circuit between the post and the nut. In some embodiments, insert edges 1741, 1751 contact one or more parts of the connector such as the nut inner shoulder 371 adjacent to the nut inner groove 361.

FIGS. 18A-E show alternative transverse grounding insert tab designs 1800A-E. In each figure, a nut 241 encircles a grounding insert 1811-1815 and a post 1831-1835. Each grounding insert includes a respective transverse tab 1871-1875 and a respective tab wiper 1851-1855.

As the figures show, the tab wipers 1851-1855 slidingly engage flanges of respective posts 1831-1835. In particular, the wipers 1851-1855 engage respective post radial peripheries 1821-1825.

Figure 18A:
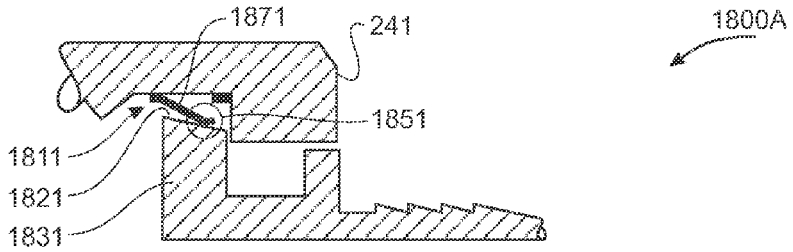
FIGS. 18A-E illustrate transverse tab post engagements.
Figure 18B:
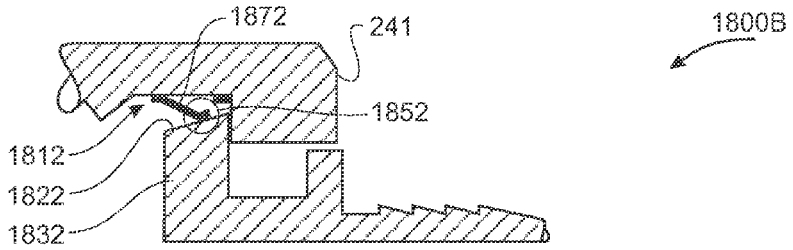
Figure 18C:
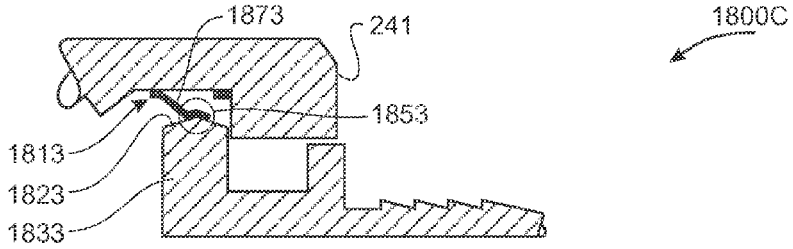
Figure 18D:
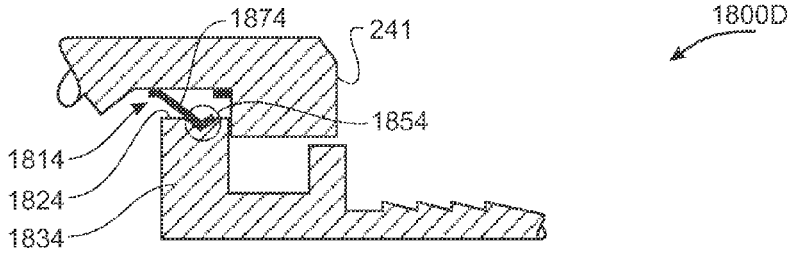
Figure 18E:
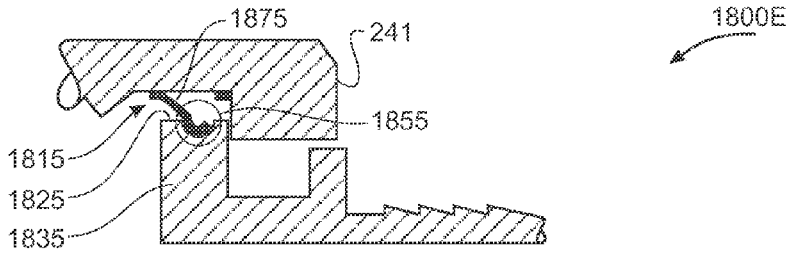

FIG. 18A shows a radial post periphery that singly sloped rearwardly 1821 and which is engaged by a "v" shaped tab wiper 1851. FIG. 18B shows a radial post periphery that is singly sloped forwardly 1822 and which is engaged by a "v" shaped tab wiper 1852. FIG. 18C shows a radial post periphery that is doubly sloped to form a peak 1823 and which is engaged by an "n" shaped (rotated "v") tab wiper 1853. FIG. 18D shows a radial post periphery that is notched 1824 and which is engaged by a "v" shaped tab wiper 1854. FIG. 18E shows a radial post periphery that is grooved 1825 and which is engaged by a "u" shaped tab wiper 1855.

As skilled artisans will appreciate, the post engagement designs of FIG. 18A-E provide improved grounding performance. In particular, the grounding insert tab wipers and mating radial post peripheries enhance grounding using enlarged post flange contact zones and biased engagements.

In another embodiment, FIGS. 19A-D show a first cylindrical grounding insert with parallel tabs 1900A-D. Similar to the connector parts described above, parts of a connector such as an F-Type coaxial cable connector include a nut 241, a post 401, and grounding insert member 1902. In some embodiments, first and second post flanges 461, 481 define a ring groove therebetween 501 near a post front end 431. When assembled, the nut encircles the post flange(s) and the grounding insert is interposed between the post and the nut.

Figure 19B:
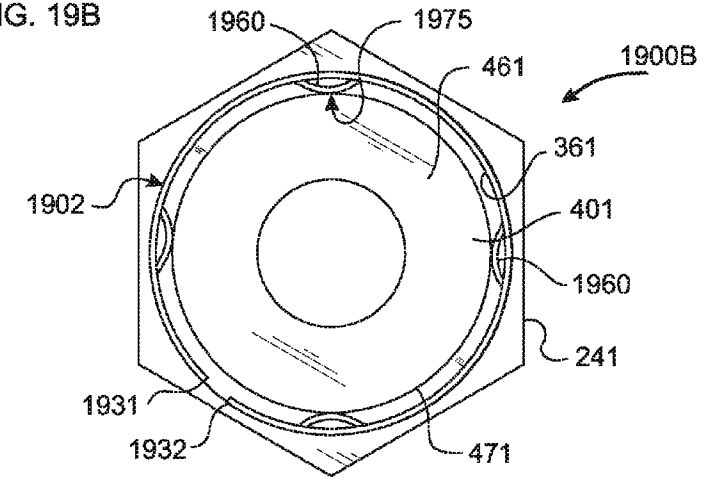
FIGS. 19A-D illustrate a first parallel tab cylindrical insert.
Figure 19D:
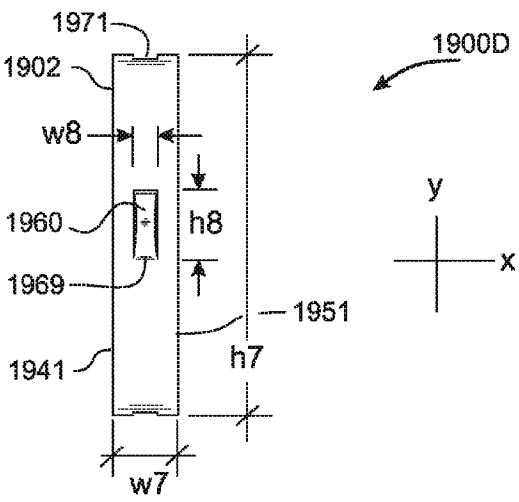
Figure 19A:
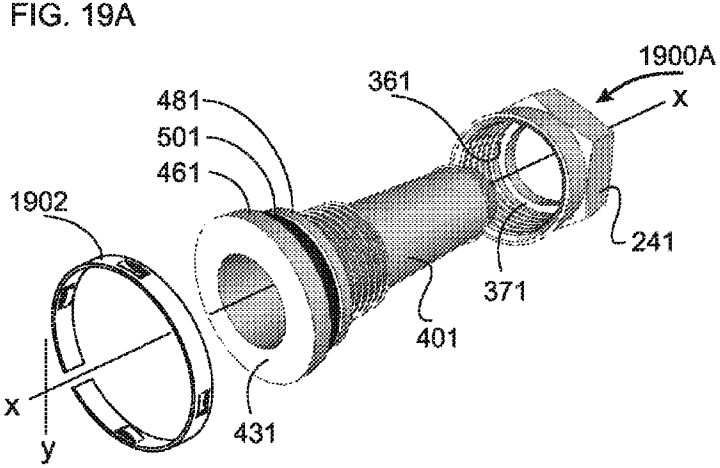
Figure 19C:
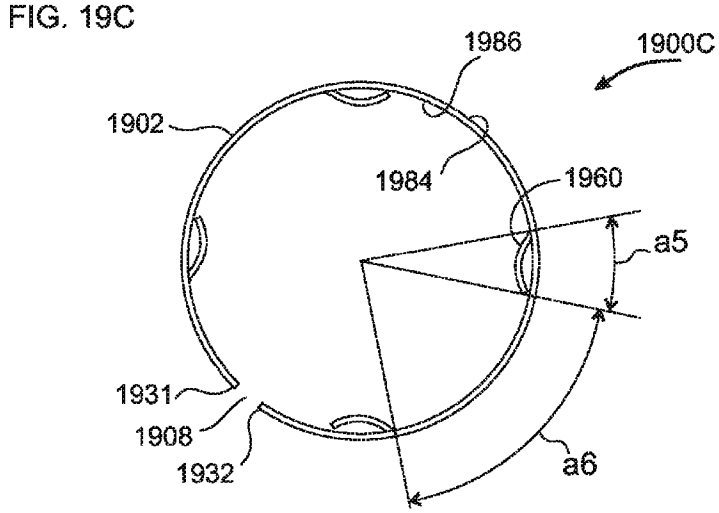

FIGS. 19C and 19D show insert end and side views respectively 1900C, 1900D. As shown in the end view, the insert 1902 has a generally circular cross-section with generally opposed ends 1931, 1932. In the side view, the insert has a width "w7" defined by edges 1941 and 1951 and a height "h7" In various embodiments w7 is selected such that the insert is accommodated by the nut internal ring groove 361. In some embodiments, the insert cross-section is broken 1908 (as shown). And, in some embodiments the insert cross-section is continuous with no break (not shown).

This first cylindrical grounding insert 1902 has a width w7 a height h7, and includes a plurality of parallel tabs 1960. As shown in FIGS. 19C-D, the tabs are parallel to the edges 1941, 1951 of the grounding insert and parallel to a connector radial or y-y axis. In various embodiments, the tabs extend toward the x-x axis and in various embodiments the tabs extend away from the x-x axis.

As shown, the insert tabs 1960 extend toward the x-x axis. While generally rectangular tabs are shown, any suitable shape may be selected. For example, a tab shape may be selected to mate with a particular post shape such as a generally cylindrical post flange peripheral face 471. As shown, a rectangular tab 1960 shape is formed when the rectangular tab is severed from adjacent material along three sides leaving a fourth un-severed side or bend line 1969 that supports the tab.

Tabs 1960 may be evenly spaced or irregularly spaced around the insert 1902 circumference. Tab width w8 is limited by insert width w7 while tab height h8 is influenced by required tab deflection 1971 and resilience given insert material geometry and properties. In the embodiment of FIG. 19C, tabs have a circumferental measure indicated by angle "a5" and tabs are separated by an angle "a6" such that four tabs are evenly arranged around the circumference of the insert.

FIG. 19B shows an end view of the assembled connector parts 1900B. Here, the insert 1902 encircles a post flange such as the forward post flange 461. In various embodiments, the insert is configured to grasp a post flange periphery such as a radial periphery 471 of the forward post flange 461. And, in various embodiments, the tabs contact a portion of the post 1975.

Referring to FIG. 19C, the circular insert 1902 provides a means for a somewhat circular engagement and is severed along a transverse line to create a break 1908. This break enables the band to resiliently expand and contract about a mating object encircled by the insert. Post chamfering and/or insert flaring may be used to ease assembly of the insert onto the radial periphery 471 of the forward post flange 461. In various embodiments, the insert break 1908 opens up as the insert is fitted to the post flange and the insert tabs contact and exert a force on post portions such as the radial periphery of the forward post flange 471.

As skilled artisans will appreciate, electrically conductive inserts provide a ground path between the post and the nut when portion(s) of the insert contact the nut and the post. For example, one or more of tabs 1960 contact the post 401 and while insert outer surface(s) 1984 contact the nut 241 and complete an electrical circuit between the post and the nut. In some embodiments, insert edges 1941, 1951 contact one or more parts of the connector such as the nut inner shoulder 371 adjacent to the nut inner groove 361.

In another embodiment, FIGS. 20A-D show a second cylindrical grounding insert with parallel tabs 2000A-D. Similar to the connector parts described above, parts of a connector such as an F-Type coaxial cable connector include a nut 241, a post 401, and grounding insert member 2002. In some embodiments, first and second post flanges 461, 481 define a ring groove therebetween 501 near a post front end 431. When assembled, the nut encircles the post flange(s) and the grounding insert is interposed between the post and the nut.

Figure 20B:
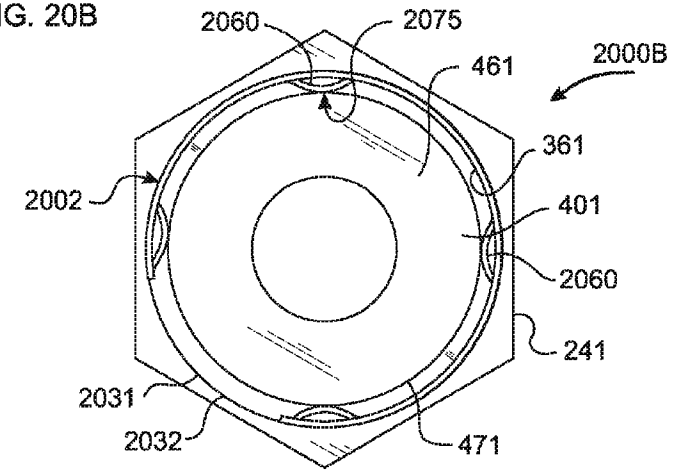
FIGS. 20A-D illustrate a second parallel tab cylindrical insert.
Figure 20A:
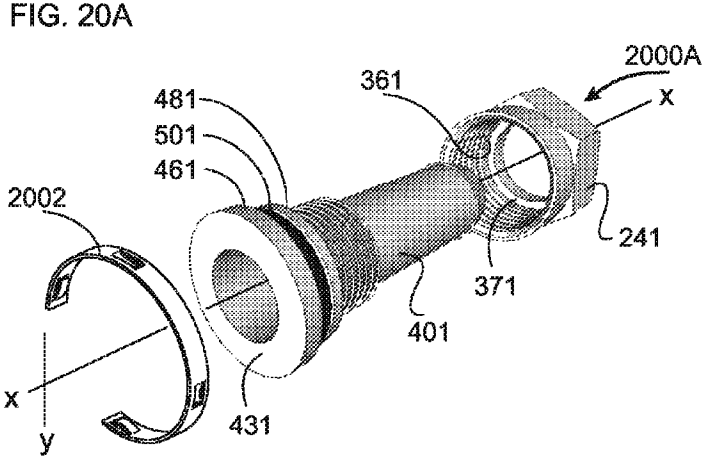
Figure 20D:
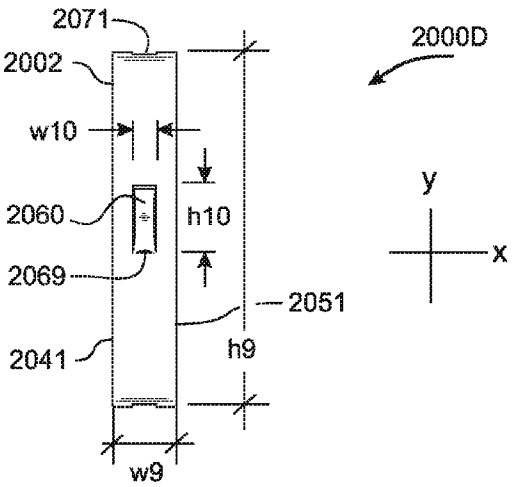
Figure 20C:
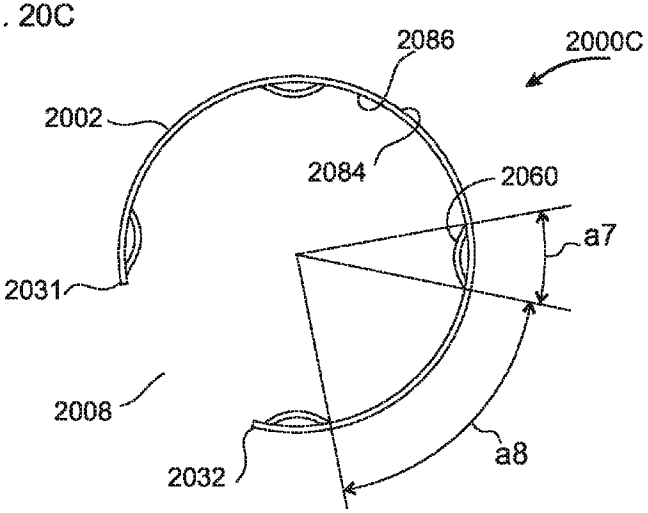

FIGS. 20C and 20D show insert end and side views respectively 2000C, 2000D. As shown in the end view, the insert 2002 has a generally circular cross-section with outer 2084 and inner 2086 sides. As shown in the side view, the insert has a width "w9" defined by edges 2041 and 2051 and a height "h9." In various embodiments w9 is selected such that the insert is accommodated by the nut internal ring groove 361. In some embodiments, the insert cross-section is open with a gap 2008 (as shown) with ends 2031, 2032. And, in some embodiments the insert cross-section is continuous with no gap (not shown).

This first cylindrical grounding insert 2002 has a width w9 a height h9, and includes a plurality of parallel tabs 2060. As shown in FIGS. 20C-D, the tabs are parallel to the edges 2041, 2051 of the grounding insert and parallel to a connector radial or y-y axis. In various embodiments, the tabs extend toward the x-x axis and in various embodiments the tabs extend away from the x-x axis.

As shown, the insert tabs 2060 extend toward the x-x axis. While generally rectangular tabs are shown, any suitable shape may be selected. For example, a tab shape may be selected to mate with a particular post shape such as a generally cylindrical post flange peripheral face 471. As shown, a rectangular tab 2060 shape is formed when the rectangular tab is severed from adjacent material along three sides leaving a fourth un-severed side or bend line 2069 that supports the tab.

Tabs 2060 may be evenly spaced or irregularly spaced around the insert 2002 circumference. Tab width w10 is limited by insert width w9 while tab height h10 is influenced by required tab deflection 2071 and resilience given insert material geometry and properties. In the embodiment of FIG. 20C, tabs have a circumferental measure indicated by angle "a7" and tabs are separated by an angle "a8" such that four tabs are evenly arranged around the circumference of the insert.

FIG. 20B shows an end view of the assembled connector parts 2000B. Here, the insert 2002 encircles a post flange such as the forward post flange 461. In various embodiments, the insert is configured to grasp a post flange periphery such as a radial periphery 471 of the forward post flange 461. And, in various embodiments, the tabs conform with a portion of the post 2075.

Referring to FIG. 20C, the circular insert 2002 provides a means for a somewhat circular engagement and is open with a gap 2008. As shown, a measure of the gap is approximated by an angle a8 measured between adjacent tabs. This gap enables the band to resiliently expand and contract about a mating object encircled by the insert. Post chamfering and/or insert flaring may be used to ease assembly of the insert onto the radial periphery 471 of the forward post flange 461. In various embodiments, the insert gap 2008 opens up as the insert is fitted to the post flange and the insert tabs contact and exert a force on post portions such as the radial periphery of the forward post flange 471.

As skilled artisans will appreciate, electrically conductive inserts provide a ground path between the post and the nut when portion(s) of the insert contact the nut and the post. For example, one or more of tabs 2060 contact the post 401 and while insert outer surface(s) 2084 contact the nut 241 and complete an electrical circuit between the post and the nut. In some embodiments, insert edges 2041, 2051 contact one or more parts of the connector such as the nut inner shoulder 371 adjacent to the nut inner groove 361.

FIGS. 21A-E show alternative transverse grounding insert tab designs 2100A-E. In each figure, a nut 241 encircles a grounding insert 2111-2115 and a post 2131-2135. Each grounding insert includes a respective parallel tab 2171-2175 and a respective tab wiper 2151-2155.

As the figures show, tab wipers 2151-2155 slidingly engage respective post flanges 2131-2135. In particular, the wipers 2151-2155 engage respective post flange radial peripheries 2121-2125.

Figure 21A:
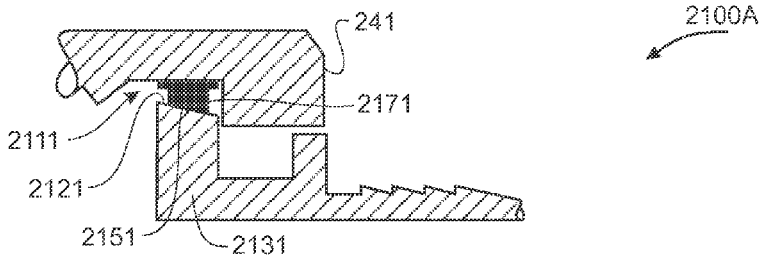
FIGS. 21A-E illustrate parallel tab post engagements.
Figure 21B:
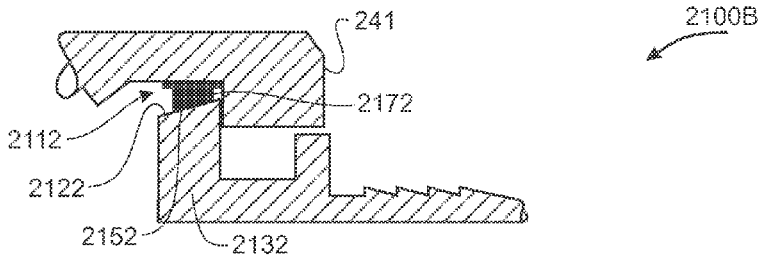
Figure 21C:
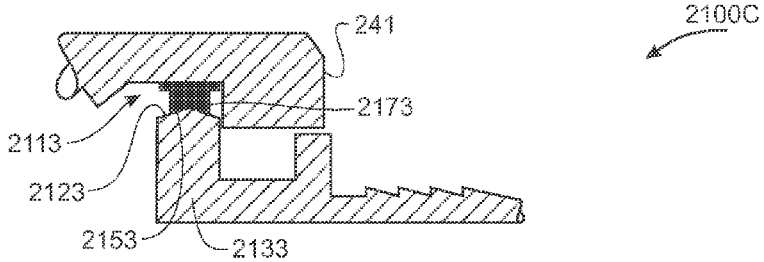
Figure 21D:
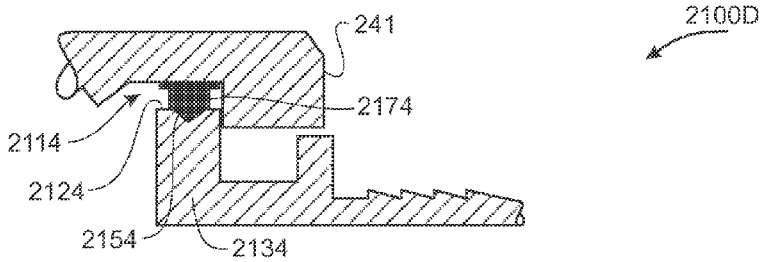
Figure 21E:
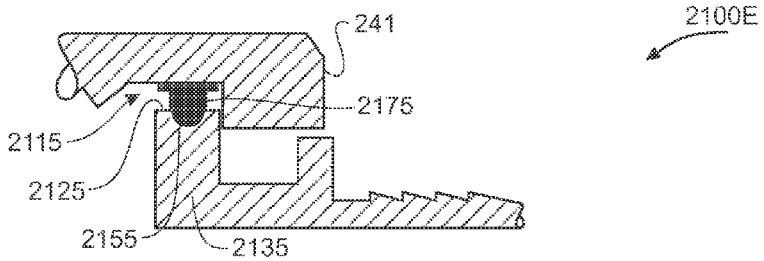

FIG. 21A shows a radial post periphery that is singly sloped rearwardly 2121 and which is engaged by a mating rearwardly sloped tab wiper 2151. FIG. 21B shows a radial post periphery that is singly sloped forwardly 2122 and which is engaged by a mating forwardly sloped tab wiper 2152. FIG. 21C shows a radial post periphery that is doubly sloped to form a peak 2123 and which is engaged by a mating doubly sloped or somewhat "n" shaped tab wiper 2153. FIG. 21D shows a radial post periphery that is notched or grooved 2124 and which is engaged by a mating "v" shaped tab wiper 2154. FIG. 21E shows a radial post periphery that is notched or grooved 2125 and which is engaged by a mating "u" shaped tab wiper 2155.

As skilled artisans will appreciate, the post engagement designs of FIG. 21A-E provide improved grounding performance. In particular, the grounding insert tab wipers and mating radial post peripheries enhance grounding using, for example, enlarged post flange contact zones and biased engagements.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A connector ground continuity method comprising the steps of:

providing a coaxial cable connector including a threaded nut with a nut interior;

providing an elongated, hollow post, the post including a portion that abuts the nut interior for rotatably coupling said post to said nut;

coaxially disposing a tubular body over said post;

slidably coupling the body and a tubular end cap; and, providing an insert including a post adjacent portion and a nut adjacent portion;

wherein the insert completes an electrical path between the nut and the post by simultaneously contacting and grasping the post with said post adjacent portion while contacting the nut interior with said nut adjacent portion.

2. The method of claim 1, wherein the insert comprises a resilient circular band for contacting the nut interior and a plurality of clips formed on the band for grasping said post.

3. The method of claim 1, wherein the insert has opposed ends, one end adjoining facets and the other end adjoining vertices.

4. The method of claim 1, wherein the insert includes a resilient band having a polygonal cross section for contacting the nut interior and grasping said post.

5. The method of claim 4, wherein said band includes a plurality of radially spaced apart vertices and a plurality of radially spaced apart facets, the vertices contacting said nut interior and the facets grasping said post.

6. A connector ground continuity method comprising the steps of:

providing a coaxial cable connector including a threaded nut;

providing an elongated, hollow post, the post including a portion that abuts the nut interior for rotatably coupling said post to said nut;

coaxially disposing a tubular body over said post, the body having opposed forward and trailing portions, the forward portion engaging the post;

slidably coupling the body trailing portion and a tubular end cap;

providing a polygonal springform insert including inner and outer sides;

the insert inner side engaging a periphery of the post; and, the insert outer side engaging an interior of the nut;

wherein the insert completes an electrical path between the nut and the post by simultaneously contacting and grasping the post with said inner side while contacting the nut interior with said outer side.

7. A connector ground continuity method comprising the steps of:

providing a coaxial cable connector including a threaded nut;

providing an elongated, hollow post, the post including a portion that abuts a nut interior for rotatably coupling said post to said nut;

coaxially disposing a tubular body over said post, the body having opposed forward and trailing portions, the forward portion engaging the post;

slidably coupling the body trailing portion and a tubular end cap;

providing a continuously curved springform insert having a wall defining inner and outer surfaces;

providing plural tabs extending from the insert inner surface toward an insert axis of revolution; and, the insert tabs engaging a periphery of the post when the insert outer surface engages an interior surface of the nut;

wherein the insert completes an electrical path between the nut and the post by simultaneously grasping the post with said tabs while contacting the nut interior with said outer side.

8. The method of claim 7 above further comprising insert material removal zones forming the tabs.

9. The method of claim 8 above further comprising insert material removal zones forming plural tabs with a transverse orientation with respect to the insert wall.

10. The method of claim 8 above further comprising insert material removal zones forming plural tabs with an orientation that is not transverse with respect to the insert wall.

11. The method of claim 9 above further comprising a tab free end.

12. A connector ground continuity method comprising the steps of:

providing a coaxial cable connector having a longitudinal axis;

providing a connector post including a post end that abuts a fastener interior;

the post rotatably coupling a body and the fastener; and, providing a connector insert including a post contactor and a nut contactor;

wherein the post contactor is configured to slide on a peripheral portion of the post end and the nut contactor is configured to slide on an interior of the fastener for the purpose of completing an electrical circuit between the fastener and the post.

13. The method of claim 12 wherein the post end peripheral portion is radially oriented with respect to the connector longitudinal axis.

14. The method of claim 13 wherein the post contactor is oriented about parallel to the connector longitudinal axis and the post end peripheral portion is singly sloped with respect to a connector longitudinal axis.

15. The method of claim 13 wherein the post contactor is oriented about parallel to the connector longitudinal axis and the post end peripheral portion is multiply sloped with respect to a connector longitudinal axis.

16. The method of claim 13 wherein the post contactor is oriented about parallel to the connector longitudinal axis and the post end peripheral portion includes a recess that slidingly seats the post contactor.

17. The method of claim 13 wherein the post contactor is oriented about perpendicular to the connector longitudinal axis and the post end peripheral portion is singly sloped with respect to a connector longitudinal axis.

18. The method of claim 13 wherein the post contactor is oriented about perpendicular to the connector longitudinal axis and the post end peripheral portion is multiply sloped with respect to a connector longitudinal axis.

19. The method of claim 13 wherein the post contactor is oriented about perpendicular to the connector longitudinal axis and the post end peripheral portion includes a recess that slidingly seats the post contactor.

* * * * *